US008905257B2

(12) United States Patent
Brown et al.

(10) Patent No.: US 8,905,257 B2
(45) Date of Patent: Dec. 9, 2014

(54) GREASE CONTAINER

(71) Applicant: Wastequip, LLC, Charlotte, NC (US)

(72) Inventors: Kevin L. Brown, Nolensville, TN (US); D. Eric Howell, Lynchburg, TN (US); Anne Brantley, Mount Holly, NC (US); Bram Chappell, Murfreesboro, TN (US)

(73) Assignee: Wastequip, LLC, Charlotte, NC (US)

( * ) Notice: Subject to any disclaimer, the term of this patent is extended or adjusted under 35 U.S.C. 154(b) by 0 days.

(21) Appl. No.: 13/902,279

(22) Filed: May 24, 2013

(65) Prior Publication Data

US 2013/0313256 A1 Nov. 28, 2013

Related U.S. Application Data

(60) Provisional application No. 61/651,366, filed on May 24, 2012.

(51) Int. Cl.

| | |
|---|---|
| ***B65D 55/02*** | (2006.01) |
| ***B65D 51/24*** | (2006.01) |
| ***B65F 1/14*** | (2006.01) |
| ***B65F 1/16*** | (2006.01) |
| ***B65F 1/02*** | (2006.01) |
| ***B65F 1/12*** | (2006.01) |

(52) U.S. Cl.

CPC ..... *B65F 1/1607* (2013.01); *B65F 1/16* (2013.01); *B65F 1/02* (2013.01); *B65F 1/1468* (2013.01); *B65F 2240/142* (2013.01); *B65F 2250/114* (2013.01); *B65F 2250/111* (2013.01); *B65F 1/1615* (2013.01); *B65F 1/122* (2013.01); *B65F 2250/112* (2013.01)

USPC ..... 220/254.3; 220/315; 220/323; 220/345.2; 220/372

(58) Field of Classification Search

USPC ..... 220/372, 315, 323, 345.2, 254.3, 314

See application file for complete search history.

(56) References Cited

U.S. PATENT DOCUMENTS

| | | | | |
|---|---|---|---|---|
| 4,028,630 | A | | 6/1977 | Graffenberger et al. |
| 4,199,075 | A | | 4/1980 | Rohrer |
| 4,319,762 | A | * | 3/1982 | Streit et al. ..... 280/79.2 |
| 4,335,828 | A | | 6/1982 | Robinson et al. |
| 4,373,849 | A | | 2/1983 | Robinson |
| 4,450,828 | A | | 5/1984 | Onken et al. |
| 4,624,468 | A | | 11/1986 | Onken |
| 4,778,209 | A | | 10/1988 | Zosky et al. |
| 5,118,000 | A | * | 6/1992 | Howell et al. ..... 220/315 |
| D373,876 | S | | 9/1996 | Onken |
| 5,718,220 | A | | 2/1998 | Onken |
| 5,813,556 | A | | 9/1998 | Onken |
| 5,850,503 | A | | 12/1998 | Onken |
| 5,887,806 | A | | 3/1999 | Onken |

(Continued)

OTHER PUBLICATIONS

Caparella, Tina, "Grease Recyclers Rejoice", Render Manazine, pp. 10-11, Oct. 2009.

(Continued)

*Primary Examiner* — Mickey Yu
*Assistant Examiner* — Niki Eloshway
(74) *Attorney, Agent, or Firm* — K&L Gates LLP

(57) ABSTRACT

The invention is generally applicable to a container. More specifically, the invention is applicable to a container for the collection, storage and transport of waste and refuse material, such as food grease generated by restaurants, schools, hospitals, grocery stores, hotels and other institutions that generate waste food grease.

6 Claims, 13 Drawing Sheets

(56) References Cited

U.S. PATENT DOCUMENTS

| | | | | |
|---|---|---|---|---|
| 5,908,551 | A | 6/1999 | Onken | |
| 5,911,346 | A | 6/1999 | Onken | |
| 5,938,250 | A | 8/1999 | Onken | |
| 5,996,831 | A * | 12/1999 | Teok | 220/230 |
| 6,157,776 | A | 12/2000 | Onken | |
| D460,289 | S | 7/2002 | Onken | |
| D460,876 | S | 7/2002 | Onken | |
| 6,981,498 | B2 | 1/2006 | Onken | |
| 6,996,336 | B1 | 2/2006 | Mahoney et al. | |
| 8,246,824 | B2 * | 8/2012 | Larin | 210/237 |
| 8,511,501 | B2 | 8/2013 | Onken, Jr. et al. | |
| 2005/0121022 | A1 | 6/2005 | Onken | |
| 2007/0062953 | A1 * | 3/2007 | Lin | 220/345.5 |
| 2007/0084790 | A1 * | 4/2007 | Batten et al. | 210/523 |
| 2011/0095040 | A1 | 4/2011 | Onken, Jr. et al. | |
| 2011/0120996 | A1 * | 5/2011 | Larin | 220/212 |

OTHER PUBLICATIONS

Onken Incorporated, New Products, accessed through the world wide web on Apr. 12, 2011, 6 pgs.

* cited by examiner

GREASE CONTAINER

RELATED APPLICATION

This application is a U.S. Non-Provisional Patent Application which claims priority to U.S. Provisional Patent Application Ser. No. 61/651,366, filed on May 24, 2012 and titled "Grease Container," which is hereby incorporated by reference in its entirety.

TECHNICAL FIELD

The invention is generally applicable to a container. More specifically, the invention is applicable to a container for the collection, storage and transport of waste and refuse material, such as food grease generated by restaurants, schools, hospitals, grocery stores, hotels and other institutions that generate waste food grease.

BACKGROUND OF INVENTION

Food grease, such as food grease generated by restaurants, schools, hospitals, grocery stores, hotels and other institutions that generate waste food grease are frequently collected, stored and transported in containers. Certain state and federal regulations require that generators of food grease collect and dispose such grease responsibly. As the demand for alternative fuels rise, so does the demand for recyclable grease, which provides food grease generating institutions with an opportunity to recycle or sell their food grease. The increased value associated with food grease has led to incidents of grease theft. Accordingly, it is desirable to provide containers for the collection, storage, transport, and disposal of material, such as food grease. It is desirable to provide such containers which provide security against the theft of the contents of the container and prevents the contamination of the contents. It is also desirable to provide a container that is adapted to facilitate the emptying of the contents of the container, for example, by use of a vacuum or dumping. Accordingly, there is a general need to provide a container for the collection, storage, transport, and disposal of material, such as food grease, which provides security against the theft of the contents of the container, prevents the contamination of the contents, and facilitates the emptying of the contents of the container.

Features and advantages of the invention will be set forth in part in the description which follows, and in part will be obvious from the description, or may be learned by practice of the invention. The accompanying drawings, which are incorporated in and constitute a part of this specification, illustrate several embodiments of the invention, and together with the description, serve to explain the principles of the invention.

DETAILED DESCRIPTION OF THE INVENTION

Figure 1:
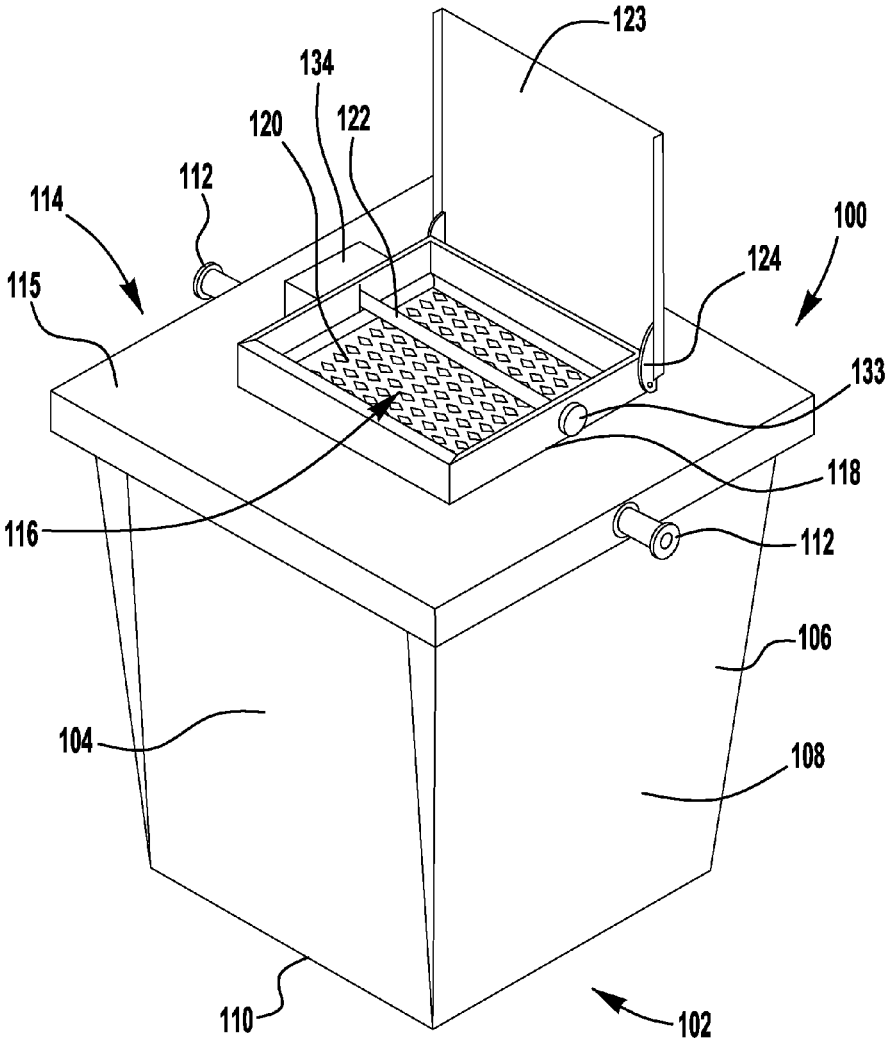
FIG. 1 shows a perspective view of an exemplary embodiment of a container.

The present invention will now be described with occasional reference to specific embodiments of the invention. This invention may, however, be embodied in different forms and should not be construed as limited to the embodiments set forth herein. Rather, these embodiments are provided so that this disclosure will fully convey the scope of the invention to those skilled in the art and are not intended to limit the scope of the invention in any way.

Also, while the detailed exemplary embodiments described in the specification and illustrated in the drawings relate to a container for the collection, storage and transport of waste and refuse materials, particularly food grease waste, it should be understood that the container described herein may be used for the collection, storage and transport of any material and the container described herein is not limited to use with food grease or waste and refuse materials only.

Except as otherwise specifically defined herein, all terms used herein have the same meaning as commonly understood by one of ordinary skill in the art to which this invention belongs. The terminology used in the description of the invention herein is for describing particular embodiments only, and is not intended to be limiting of the invention. As used in the description of the invention, the singular forms "a," "an," and "the" are intended to include the plural forms as well, unless the context clearly indicates otherwise.

Unless otherwise indicated, all numbers expressing quantities, properties, and so forth as used in the specification are to be understood as being modified in all instances by the term "about." Accordingly, unless otherwise indicated, the numerical properties set forth in the following specification are approximations that may vary depending on the desired properties sought to be obtained in embodiments of the present invention. Notwithstanding that the numerical ranges and parameters setting forth the broad scope of the invention are approximations, the numerical values to the extent that such are set forth in the specific examples are reported as precisely as possible. Any numerical values, however, inherently contain certain errors necessarily resulting from error found in their respective measurements.

First Exemplary Embodiment of Container

FIG. 1 shows one exemplary embodiment of a container 100. Referring to FIG. 1, the container 100 includes a receptacle portion 102 made up of a front wall 104, a rear wall 106, a pair of side walls 108 and a bottom wall 110, which combine to create a partially enclosed space. The shape and configuration of each of walls 104, 106, 108 and 110 of container 100 may vary in various embodiments. In addition, the overall shape of container 100 may also vary in various embodiments. As shown in FIG. 1, the exemplary embodiment of the container 100 has a generally rectangular prism shape, with each of the walls 104, 106, 108 and 110 having a generally four-sided polygonal shape. However, the container 100 is not limited to the shape of the exemplary embodiment of container 100 and additional embodiments of the container 100 could have a variety of suitable shapes.

The container 100 of the present application may have a variety of different sizes. The exemplary embodiment of container 100 illustrated in FIGS. 1-2 has a capacity of approximately 100 gallons. However, additional embodiments of the container may be of a variety of suitable sizes, including but not limited to 200 gallon, 300 gallon or 360 gallon containers or various other sizes.

The front wall 104, rear wall 106, pair of side walls 108, and bottom wall 110 of the illustrated embodiment of the container 100 may be formed of one or more of a variety of suitable materials. The particular material is generally selected to be compatible with the intended purpose and desired qualities of the container 100. For example, in various embodiments, the walls 104, 106, 108 and 110 of container 100 may be made from one or a combination of metals, such as steel or aluminum. In various additional embodiments, the walls 104, 106, 108 and 110 of container 100 may be made from one or a combination of thermoplastic or elastomeric materials, such as plastic. The container 100 may be manufactured by one of a variety of methods of making containers that are well known in the art. For example, containers 100 with metal walls can be constructed by welding the walls together and containers with walls of thermoplastic or elastomeric materials may be constructed by a molding process, such as a rotational molding process.

Use of a variety of materials in making the walls 104, 106, 108 and 110 of the container 100 permits the selection of a broad range of possible material properties, including the properties of rigidity, flexibility, elasticity, thermal and chemical resistance, odor resistance, corrosion resistance, electrical resistance/conductance, mechanical abrasion resistance, color, transparency/opacity and texture. According to some embodiments of the invention, the container walls 104, 106, 108 and 110 of the container 100 may be made entirely from one material that has uniform properties. According to other embodiments of the invention, various parts of the walls 104, 106, 108 and 110 of the container 100 may be made from different materials to provide varied properties at discrete portions of the container 100. For example, in certain embodiments, all or a portion of some of the walls 104, 106, 108 and 110 of the container 100 may be formed of metal while the remaining walls or wall portions are formed of thermoplastic or elastomeric materials.

In various additional embodiments of the container 100, the container 100 may include forklift receiving pockets which are adapted to receive the forks of a forklift or other similar device to permit the forklift to lift, move or empty the contents of container 100. In yet additional embodiments, the container 100 may include legs or supports that serve to raise the bottom wall 110 of container 100 off of the ground but do not receive forks of a forklift or other similar device. Yet further additional embodiments of container 100 may be supported on wheels or sliders that both support the container off the ground and also allow the container to be easily moved or repositioned. Furthermore, in additional embodiments of container 100, the bottom wall 110 of container 100 may rest directly on the supporting surface and not be raised up in any manner.

Figure 2:
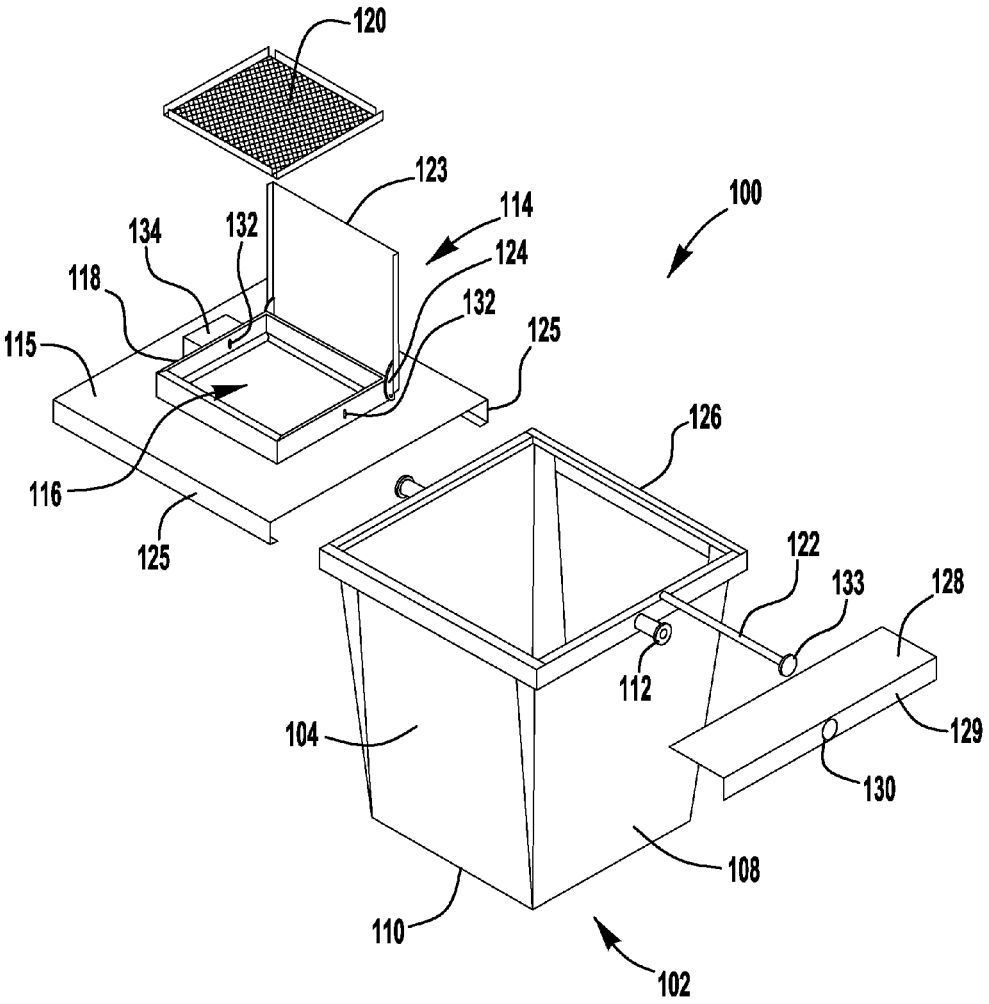
FIG. 2 shows an exploded perspective view of the embodiment of the container in FIG. 1.

As shown in FIGS. 1-2, the exemplary embodiment of container 100 includes a dumping peg 112 projecting from each side wall 108. The pair of dumping pegs 112 are utilized by a waste removal vehicle, such as a garbage truck, to lift and dump the container 100 to empty the contents of the container. The container 100 may have any number of dumping pegs 112. The dumping pegs 112 may have a variety of shapes, sizes and configurations and be located on various portions of the container 100 in various embodiments of container 100. For example, the dumping pegs 112 may be located on one or more of the front wall 104 or back wall 106 in additional embodiments. Additional embodiments of container 100 may also be provided with additional dump assisting devices, such as fork-receiving sleeves located on the side walls 108 for receiving the fork assembly of a waste removal vehicle or forklift, in place of or in addition to the dumping pegs 112. In addition, the container may be provided without any dumping pegs or fork receiving sleeves and the container may simply be grasped directly and lifted by a waste removal vehicle. In addition, embodiments of container 100 may be emptied by the use of vacuum devices that do not require that the container 100 be raised and/or dumped. Rather, a vacuum tube or other vacuum device is inserted into the container 100 and the contents of the container are sucked out.

As shown in FIG. 1, the exemplary embodiment of container 100 includes a top lid 114 which encloses the receptacle portion 102 of the container 100 to prevent undesired entry into the container 100, such as by potential grease thieves (using, for example, a vacuum tube), animals, etc. Top lid 114 may have a variety of different suitable shapes, sizes and configurations. The top lid 114 of the illustrated embodiment may be formed from a variety of materials. In the embodiment of container 100 illustrated in FIG. 1, top lid 114 is made from one or a combination of metals, such as steel or aluminum. In various additional embodiments, the top lid 114 may be made from one or a combination of thermoplastic or elastomeric materials, such as plastic. In yet additional embodiments, various parts of top lid 114 may be made from different materials to provide varied properties at discrete portions of the lid. For example, in certain embodiments, a portion of top lid 114 may be formed of metal while the remaining portions of the lid is formed of thermoplastic or elastomeric materials. The top lid 114 may be manufactured by one of a variety of methods of making containers that are well known in the art. For example, top lids made of metal can be constructed by welding and top lids made of thermoplastic or elastomeric materials may be constructed by molding processes, such as an injection or rotational molding process.

The illustrated embodiment of top lid 114 includes a top plate 115 with a fill opening 116 defined therethrough. The filling opening 116 is generally provided to facilitate the loading of container 100 with food grease or other materials by a user, as described in greater detail herein. The fill opening 116 may have a wide variety of different shapes and sizes. In the illustrated embodiment of container 100, the fill opening 116 has a generally rectangular shape. However, the fill opening of additional embodiments of container 100 may have a variety of different shapes. For example, the fill opening 116 of additional embodiments of container 100 may have a circular, elliptical or other suitable shape. Also, additional embodiments of container 100 may have more than one fill opening 116. For example, certain additional embodiments of container 100 may include a pair of fill openings 116, each defined through the top lid 114 or one or more of the walls 104, 106, or 108 of the container 100.

As shown in FIGS. 1-2, the fill opening 116 of the illustrated embodiment of container 100 includes a rim 118, which generally surrounds or borders the fill opening 116. The rim 118 is generally provided to help ensure that material, such as food grease, that is being poured or otherwise inserted into the container 100 enters the fill opening 116 and does not spill out onto the top lid 114 or other portion of the container 100 or the ground or other supporting surface upon which the container 100 is positioned. The rim 118 also helps to prevent undesired entry into the container 100 via fill opening 116. The rim 118 of various embodiments may have a wide variety of different shapes, sizes and configurations. Additional embodiments of the container 100 may be provided without any rim or may include a rim which only surrounds a portion of fill opening.

The fill opening 116 of the top lid 114 of illustrated embodiment of container 100 includes a grate or screen 120, which covers the fill opening 116. The screen 120 is generally provided to allow for the passage of material that are desired to be inserted into container 100, such as food grease, but to help prevent trash, debris, food matter, or other contaminants from entering container 100. Screen 120 also generally serves to prevent undesired entry into the container 100 via fill opening 116, such as by potential grease thieves (using, for example, a vacuum tube), animals, etc. The grate 120 of the illustrated embodiment is a metal, mesh screen, however additional embodiments of container may include a variety of different grates, screens, partitions, barriers or filters such as slotted plates, perforated screens, etc. which are formed from a variety of suitable materials. The screen 120 of various embodiments may have a wide variety of different shapes, sizes and configurations. Additional embodiments of the fill opening 116 of the top lid 114 of container 100 may be provided without any screen or may include a screen which only covers a portion of fill opening. As shown in FIGS. 1-2, the exemplary embodiment of container 100 includes a locking bar 122 for selectively locking the screen 120 to the top lid 114 (as described in more detail in connection with the description of the mounting of the screen 120 to the top lid 114 below).

As shown in FIGS. 1-2, the exemplary embodiment of container 100 includes an optional fill opening door 123, which selectively covers the fill opening 116 of the top lid 114. The fill opening door 123 is mounted to top lid 114 by a pair of hinges 124. Fill opening door 123 may include any number of hinges. Fill opening door 123 may be mounted to the top lid 114 of the container 100 in a variety of different ways in additional embodiments, including by use of various different types of hinges. In yet additional embodiments, fill opening door 123 may be unattached to the top lid 114 of container 100 and simply rest upon and be removable from the top lid 114 of container 100. Furthermore, in additional embodiments, the container 100 may be provided with no fill opening door 123 and the fill opening 116 defined in top lid 114 may be open at all times and uncovered by a door.

As shown in FIGS. 1-2, fill opening door 123 is selectively pivoted on hinges 124 between a closed position, in which the fill opening 116 defined within the top lid 114 is covered, and an open position, in which the fill opening 116 is uncovered. Fill opening door 123 may have a variety of different suitable shapes, sizes and configurations. Additional embodiments of container 100 may include various different types of fill opening doors. For example, in certain embodiments, fill opening door 123 may be a pair of doors that each cover half of the fill opening 116, or one or more sliding panels that slides between a closed and open position or a rotating door that rotates between a closed and open position.

The fill opening door 123 may be formed from a variety of materials. In the embodiment of container 100 illustrated in FIG. 1-2, fill opening door 123 is made from one or a combination of metals, such as steel or aluminum. In various additional embodiments, the fill opening door 123 may be made from one or a combination of thermoplastic or elastomeric materials, such as plastic. In certain embodiments, the top lid 114 and fill opening door 123 mounted on the top lid 114 may be formed from the same material and in additional embodiments, the top lid 114 and fill opening door 123 may be formed from different materials.

In additional embodiments the fill opening door 123 is selectively locked in the closed position by one or more optional securing device (not shown) to prevent undesired entry into the fill opening 116, such as by potential grease thieves (using, for example, a vacuum tube), animals, etc. Any suitable securing device may be used to secure fill opening door 123 in the closed position, such as one or more padlocks, locking bars, chains, straps, tie-downs, bungee cords, key locks, panel locks, sash locks, deadbolts, dead latches, bolt latches or other type of lock or latch. Additional embodiments of container may also include one or more additional securing devices to secure fill opening door 123 in the open position or may not include any securing device for securing fill opening door 123.

Additional embodiments of the container 100 may include a support tray (not shown) located on a portion of the container 100 to provide a place for a user of the container 100 to place or rest a waste container, trash can, pail bucket or other items, while using the container 100. For example, a user of container 100 could use optional support tray to support a grease pail while the user is opening fill opening door 123 to access fill opening 116. Once fill opening door 123 is opened and the fill opening 116 is accessible, the user could then remove the grease pail from optional support tray and dump the contents of the grease pail into container 100 via fill opening 116. Yet further additional embodiments of container 100 may include an overall container shape that provides the functions of the support tray.

Figure 5:
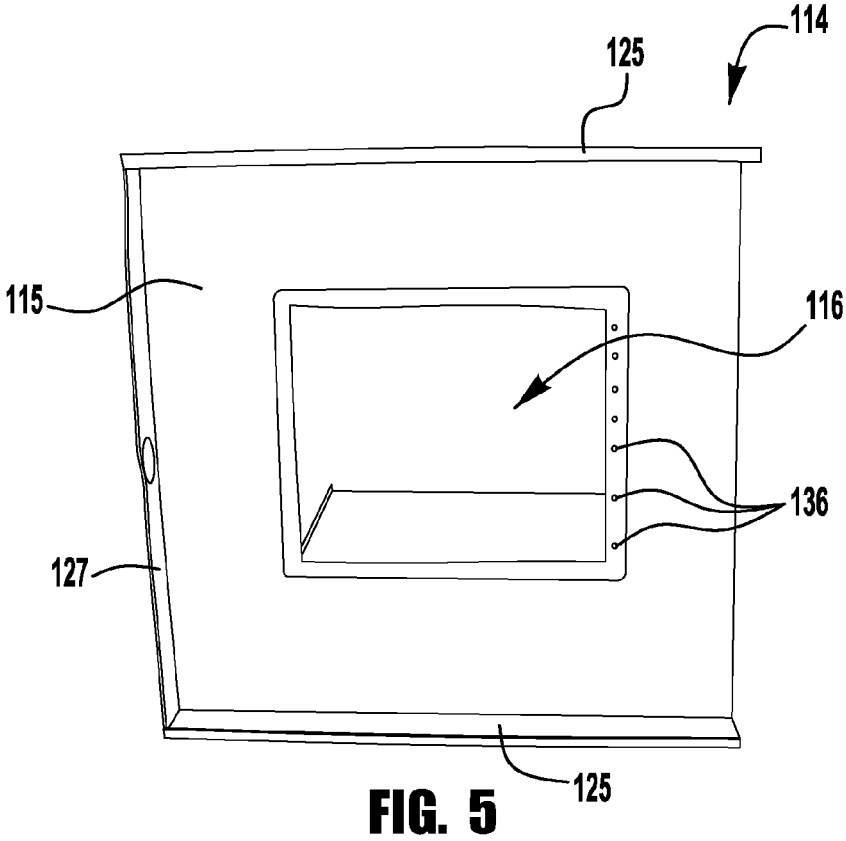
FIG. 5 shows a bottom view of the lid of the FIGS. 3A-3B.

Referring now to FIG. 2, an exploded view of the exemplary embodiment of container 100 is shown. Top lid 114 is mounted to the receptacle portion 102 of container 100 by a pair of opposing rails 125 or tracks which are slid onto rim 126 of the receptacle portion 102. The size, shape configuration and dimensions of rails 125 are configured to correspond to the size, shape configuration and dimensions of the rim of standard receptacles. In this manner, the top lid 114 may be easily and effectively retrofit to existing containers. The top lid 114 of the exemplary embodiment of container 100 is adapted for use with 100 gallon containers. However, in additional embodiments, the size, shape configuration and dimensions of rails 125 may be configured and adapted for use with other sizes (e.g., 200 gallon, 300 gallon, 360 gallon or other sized containers). As shown in FIG. 5, the underside of top lid 114 is enclosed on three sides by the pair of opposing rails 125 and a sidewall 127. Accordingly, the top lid 114 may be slid onto the rim 126 of the receptacle portion 102 (in a left to right direction when viewed in FIG. 2) until the sidewall 127 contacts the rim of the receptacle portion 102. When the rails 125 of the top lid 114 are slid onto the rim 126 of the receptacle portion 102 of the container 100, the bottom lip of the rails 125 resides below the rim 126 and prevent the top lid 114 from being raised from the receptacle portion 102. In this manner, the lid 114 cannot be removed from the receptacle portion 102 when the rails 125 are engaged with the rim 126.

To further secure the top lid 114 to the receptacle portion 102 and to prevent the top lid 114 from being slid back off of the receptacle portion 102 (e.g. by a grease thief, animal, etc.), locking end cap or bracket 128 is affixed to the top lid 114 at the end of the top lid opposite sidewall 127. In various exemplary embodiments, the locking end cap 128 is slid under or over the top lid 114 until sidewall 129 of the locking end cap 128 contacts the rim 126 of the receptacle portion 102 of the container. As shown in FIG. 2, the sidewall 129 of the locking end cap 128 includes an opening 130 that permits the locking end cap to be slid over dumping peg 112. However, in embodiments of container 100 which do not include dumping pegs 112, no such opening 130 is provided. The locking end cap 128 is then affixed in place to the top lid 114. In various embodiments of the top lid, the locking end cap 128 may be affixed to the top lid 114 using a variety of suitable attachment means. For example, in the illustrated embodiment, the locking end cap 128 is affixed to the top lid 114 using a plurality of fasteners (e.g., self drilling/tapping screws) that are inserted through a plurality of openings 136 defined through the top plate or wall 115 of the top lid 114. Once the locking end cap 128 is affixed to the top lid 114 when the top lid is mounted to receptacle portion 102, the rim 126 of the receptacle portion 102 is fully enclosed on all four sides. Accordingly, the top lid 114 is prevented from being lifted up off of the receptacle portion 102 or slid back off of the receptacle portion. The top lid 114 is prevented from being removed from the receptacle portion 102 unless and until the locking end cap 128 is removed from the top lid 114. The fact that locking end cap 128 can be moved relative to top lid 114 and properly adjusted prior to being affixed to the top lid 114 allows for adjustability of the fit of the top lid 114 relative to the rim 126 of the receptacle portion 102. In this manner, the top lid 114 can be adapted and adjusted for mounting on receptacle portions 102 having a variety of shapes and dimensions.

Figure 3A:
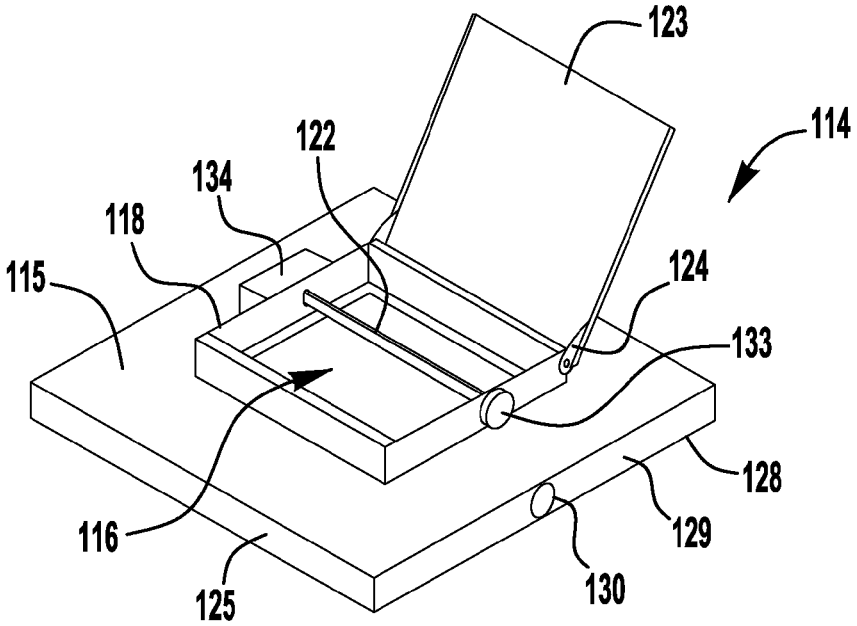
FIG. 3A-3B show perspective views of the lid of the embodiment of the container in FIG. 1.
Figure 3B:
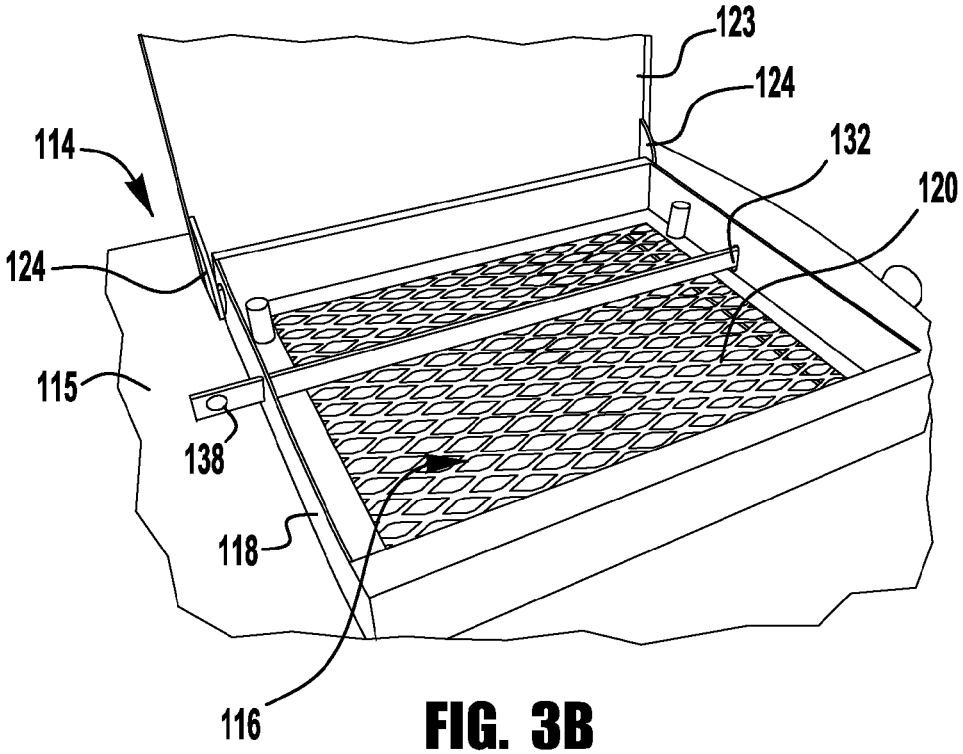

Once the top lid 114 is mounted to the receptacle portion 102, screen 120 is mounted within the rim 118 of the top lid 114 that generally surrounds or borders the fill opening 116. The shape and dimension of the screen 120 is adapted to fit closely within the rim 118. As mentioned previously, the rim 118 and screen 120 may have a variety of different shapes, sizes and configurations in various embodiments. Once the screen 120 is mounted within the rim 118, locking bar 122 is slid through openings 132 defined within opposing sides of the rim 118. The locking bar is adapted to overlay the screen 120 when the screen is mounted within the rim 118 and prevent the screen 120 from being removed from the rim 118. As shown in FIG. 2, enlarged end 133 of the locking bar 122 prevents the locking bar 122 from completely sliding through openings 132. An opening 138 is defined through an opposing end of the locking bar 122 (as shown in FIG. 3B) and is adapted for the receipt of a securing device (e.g., padlock) (not shown). An optional shroud 134 may be provided to generally enclose and house the securing device and protect the securing device to prevent a would-be thief from tampering with the securing device or attempting to remove the securing device by cutting it with bolt cutters or other cutting device. Due to the enlarged end 133 of the locking bar 122 on one end and the securing device (not shown) on the other end of the locking bar 122, the locking bar 122 is prevented from being removed from the top lid 114 unless and until the securing device is removed from the locking bar 122 and the locking bar 122 is slid back out of openings 138. The securing of the locking bar 122 within the rim 118 prevents the screen 120 from being removed from the rim 118. It should be understood that a variety of additional locking devices may be used to secure the screen 120 within the fill opening in additional embodiments.

As the openings 136 defined through the top plate 115 of the top lid 114 for affixing the locking end cap 128 to the top lid 114 of the illustrated exemplary embodiment are located within the opening defined by the rim 118 and are obstructed and made inaccessible by the screen 120 when the screen is mounted within the rim 118, the locking end cap 128 is also prevented from being removed when the screen 120 is locked within the rim 118 by the locking bar 122. In this manner, once the locking bar 122 is locked to the top lid 114 the screen 120 may not be removed. Consequently, the locking end cap 128 may also not be removed from the top lid 114 and removal of the top lid 114 from the receptacle portion 102 of the container 100 is prevented. It should be understood, however, that the openings 136 may be located or situated differently in additional embodiments and the end cap 128 may be affixed or attached to the top lid in a variety of suitable manners in additional embodiments.

When container 100 becomes full or it is otherwise desired that container 200 be emptied, a waste removal vehicle is used to empty the container 200. Typically, a vacuum device is used to empty the exemplary embodiment of container 100. When it is desired that the container 200 be emptied, locking bar 122 is removed and the screen 120 is removed from rim 118, thus leaving the fill opening 116 unobstructed. A vacuum tube or other vacuum device is then inserted into the open fill opening 116 and the contents of the container 100 are removed. Once the emptying procedure is completed, the screen 120 and locking bar 122 are reinstalled, thus preparing the container 100 to be refilled while still preventing access to the contents of the container by potential grease thieves, animals, etc. Various additional embodiments of container 100 may be emptied by a waste removal vehicle or other mechanism that grasps container 100 using dumping pegs 112 or otherwise and dumping the container 100 to remove its contents.

Second Exemplary Embodiment of Container

Figure 6:
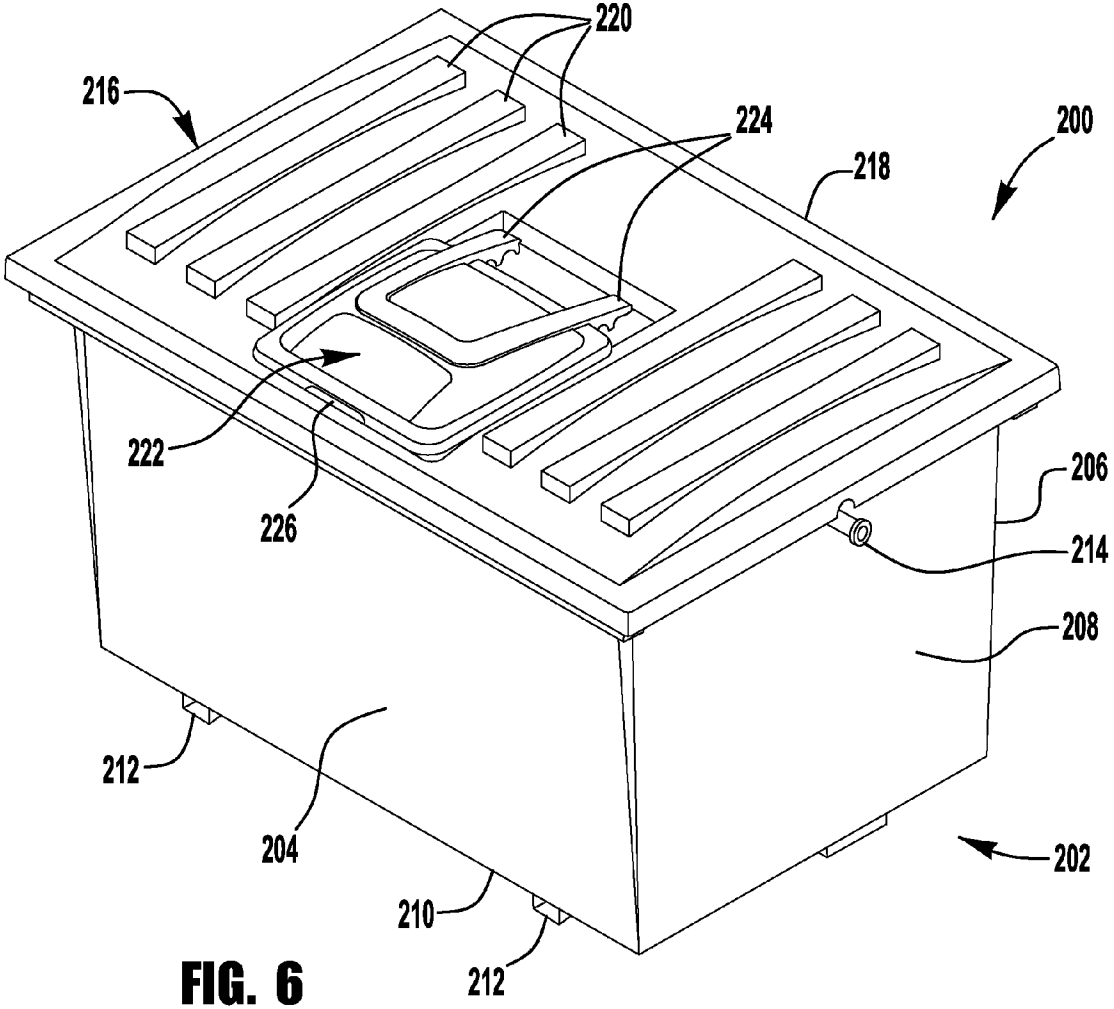
FIG. 6 shows a perspective view of a second exemplary embodiment of a container.

FIG. 6 shows a second exemplary embodiment of a container 200. Referring to FIG. 6, the container 200 includes a receptacle portion 202 made up of a front wall 204, a rear wall 206, a pair of side walls 208 and a bottom wall 210, which combine to create a partially enclosed space. The shape and configuration of each of walls 204, 206, 208 and 210 of container 200 may vary in various embodiments. In addition, the overall shape of container 200 may also vary in various embodiments. As shown in FIG. 6, the exemplary embodiment of the container 200 has a generally four-sided polygonal shape when viewed from the side. However, the container 200 is not limited to the shape of the exemplary embodiment of container 200 and additional embodiments of the container 200 could have a variety of suitable shapes.

The container 200 of the present application may have a variety of different sizes. The exemplary embodiment of container 200 illustrated in FIG. 6 has a capacity of approximately 300 gallons. However, additional embodiments of the container may be of a variety of suitable sizes, including but not limited to 100 gallon, 200 gallon, 300 gallon or 360 gallon containers or various other sizes.

The front wall 204, rear wall 206, pair of side walls 208, and bottom wall 210 according to the present invention may be formed of one or more of a variety of suitable materials. The particular material is generally selected to be compatible with the intended purpose and desired qualities of the container 200. For example, in various embodiments, the walls 204, 206, 208 and 210 of container 200 may be made from one or a combination of metals, such as steel or aluminum. In various additional embodiments, the walls 204, 206, 208 and 210 of container 200 may be made from one or a combination of thermoplastic or elastomeric materials, such as plastic. The container 200 may be manufactured by one of a variety of methods of making containers that are well known in the art. For example, containers 200 with metal walls can be constructed by welding the walls together and containers with walls of thermoplastic or elastomeric materials may be constructed by a molding process, such as a rotational molding process.

Use of a variety of materials in making the walls 204, 206, 208 and 210 of the container 200 permits the selection of a broad range of possible material properties, including the properties of rigidity, flexibility, elasticity, thermal and chemical resistance, odor resistance, corrosion resistance, electrical resistance/conductance, mechanical abrasion resistance, color, transparency/opacity and texture. According to some embodiments of the invention, the container walls 204, 206, 208 and 210 of the container 200 may be made entirely from one material that has uniform properties. According to other embodiments of the invention, various parts of the walls 204, 206, 208 and 210 of the container 200 may be made from different materials to provide varied properties at discrete portions of the container 200. For example, in certain embodiments, all or a portion of some of the walls 204, 206, 208 and 210 of the container 200 may be formed of metal while the remaining walls or wall portions are formed of thermoplastic or elastomeric materials.

As shown in FIG. 6, the illustrated embodiment of container 200 includes a pair of forklift receiving pockets 212 located beneath the bottom wall 210 of container 200, which are adapted to receive the forks of a forklift or other similar device to permit the forklift to lift, move or empty the contents of container 200. Forklift receiving pockets 212 also serve to raise the bottom wall 210 of container 200 off of the ground or other surface upon which the container 200 is supported to decrease the likelihood that bottom wall 210 may become corroded or otherwise damaged due to contact with or submersion in standing water or other liquid or moisture located on the surface beneath the container 200. Additional embodiments of container 200 may include legs or supports that serve to raise the bottom wall 210 of container 200 off of the ground but do not receive forks of a forklift or other similar device. Yet further additional embodiments of container 200 may be supported on wheels or sliders that both support the container off the ground and also allow the container to be easily moved or repositioned. Furthermore, in additional embodiments of container 200, the bottom wall 210 of container 200 may rest directly on the supporting surface and not be raised up in any manner.

As shown in FIG. 6, the exemplary embodiment of container 200 includes a dumping peg 214 projecting from each side wall 208. The pair of dumping pegs 214 are utilized by a waste removal vehicle, such as a garbage truck, to lift and dump the container 200 to empty the contents of the container. The container 200 may have any number of dumping pegs 214. The dumping pegs 214 may have a variety of shapes, sizes and configurations and be located on various portions of the container 200 in various embodiments of container 200. For example, the dumping pegs 214 may be located on one or more of the front wall 204 or back wall 206 in additional embodiments. Additional embodiments of container 200 may also be provided with additional dump assisting devices, such as fork-receiving sleeves located on the side walls 208 for receiving the fork assembly of a waste removal vehicle or forklift, in place of or in addition to the dumping pegs 214. In addition, the container may be provided without any dumping pegs or fork receiving sleeves and the container may simply be grasped directly and lifted by a waste removal vehicle.

As shown in FIG. 6, the exemplary embodiment of container 200 includes an optional top lid 216 which selectively encloses the receptacle portion 202 of the container 200. The top lid 216 is mounted to the receptacle portion 202 of container 200 by a pair of hinges 306 (shown in FIG. 8) located on a rear end 218 of lid 216. Top lid 216 may include any number of hinges. Top lid 216 may be mounted to the receptacle portion 202 of the container 200 in a variety of different ways in additional embodiments of container, including by use of various different types of hinges. In yet additional embodiments, top lid 216 may be unattached to the receptacle portion 202 of container 200 and simply rest upon and be removable from the receptacle portion 202 of container 200. Furthermore, in additional embodiments, the container 200 may be provided with no top lid 216.

Top lid 216 is selectively pivoted on hinges 306 between a closed position, in which the receptacle portion 202 of container 200 is covered, and an open position, in which the receptacle portion 202 of container 200 is uncovered. Top lid 216 may have a variety of different suitable shapes, sizes and configurations. Additional embodiments of container 200 may include various different types of lids. For example, in certain embodiments, top lid 216 may be a pair of doors that each cover half of the receptacle portion 202 of container 200 or one or more sliding panels that slides between a closed and open position.

The top lid 216 of the illustrated embodiment includes a plurality of ribs 220, which provide added strength and rigidity for the top lid. Top lid 216 may include any number of ribs 220 and the ribs may have a variety of sizes, shapes and configurations in alternative embodiments. Additional embodiments of optional top lid 216 may be provided without any such ribs. In various embodiments, top lid 216 may include an optional handle or other suitable means to assist the opening and closing of the top lid 216 by a user.

The top lid 216 of the illustrated embodiment may be formed from a variety of materials. In the embodiment of container 200 illustrated in FIG. 6, top lid 216 is made from one or a combination of thermoplastic or elastomeric materials, such as plastic. In various additional embodiments, the top lid 216 may be made from one or a combination of metals, such as steel or aluminum. In yet additional embodiments, various parts of top lid 216 may be made from different materials to provide varied properties at discrete portions of the lid. For example, in certain embodiments, a portion of top lid 216 may be formed of metal while the remaining portions of the lid is formed of thermoplastic or elastomeric materials.

The top lid 216 may be manufactured by one of a variety of methods of making containers that are well known in the art. For example, top lids made of metal can be constructed by welding and top lids made of thermoplastic or elastomeric materials may be constructed by molding processes, such as an injection or rotational molding process.

In certain embodiments, top lid 216 is selectively locked in the closed position by one or more optional securing device (not shown) to prevent undesired entry into the container 200, such as by potential grease thieves (using, for example, a vacuum tube), animals, etc. Any suitable securing device may be used to secure top lid 216 in the closed position and/or open position, such as one or more padlocks, locking bars, chains, straps, tie-downs, bungee cords, key locks, panel locks, sash locks, deadbolts, dead latches, bolt latches or other type of lock or latch. Additional embodiments of container may also include an additional securing device to secure top lid 216 in the open position or may not include any securing device for securing top lid 216. For example the top lid 216 may be provided with a locking element, such as a tabbed end cap, which corresponds with a slot or other opening defined within a portion of the receptacle portion 202. Such locking elements, which correspond with one or more slots defined within a portion of the receptacle portion 202 may be located on various portions of the top lid. For example, such tabbed end caps may be located on the rear, middle and/or sides, etc. of the top lid 216. Furthermore, a padlock or other locking element may be inserted through one or more of the tabs of the tabbed end cap to lock the top lid 216 to the receptacle portion 202.

Figure 7:
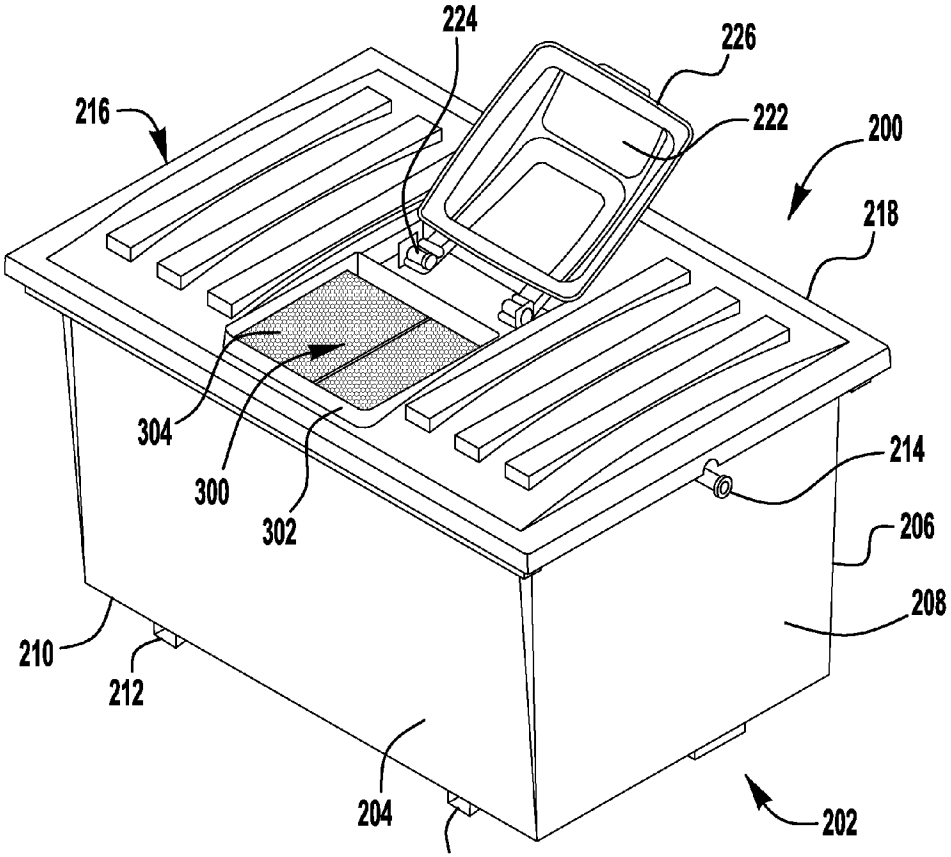
FIG. 7 shows a perspective view of the embodiment of the container in FIG. 6, with the fill opening door in a raised position.
Figure 8:
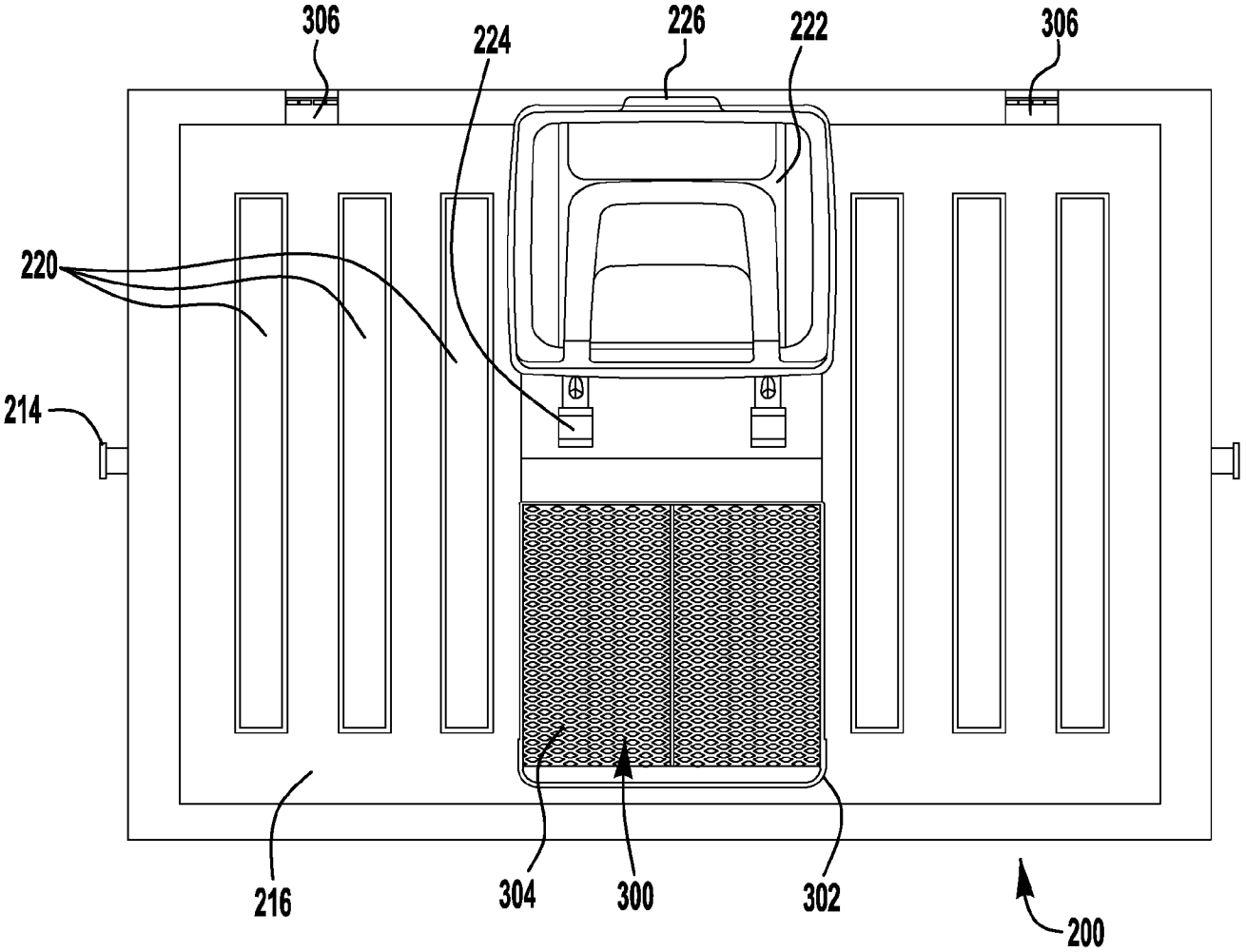
FIG. 8 shows a top view of the embodiment of the container in FIG. 6, with the fill opening door in a raised position.

Referring now to FIGS. 7-8, the illustrated embodiment of container 200 includes a fill opening 300 defined through the top lid 216. The filling opening 300 is generally provided to facilitate the loading of container 200 with food grease or other materials by a user, as described in greater detail herein. The fill opening 300 may have a wide variety of different shapes and sizes. In the illustrated embodiment of container 200, the fill opening 300 has a generally rectangular shape. However, the fill opening of additional embodiments of container 200 may have a variety of different shapes. For example, the fill opening 300 of additional embodiments of container 200 may have a circular, elliptical or other suitable shape. Also, additional embodiments of container 200 may have more than one fill opening 300. For example, certain additional embodiments of container 200 may include a pair of fill openings 300, each defined through the top lid 216 or one or more of the walls 204, 206, or 208 of the container 200.

As shown in FIGS. 7-8, the fill opening 300 of the illustrated embodiment of container 200 includes a rim 302, which surrounds the fill opening 300. The rim 302 is generally provided to help ensure that material, such as food grease, that is being poured or otherwise inserted into the container 200 enters the fill opening 300 and does not spill out onto the top lid 216 or other portion of the container 200 or the ground or other supporting surface upon which the container 200 is positioned. The rim 302 also helps to prevent undesired entry into the container 200 via fill opening 300. The rim 302 of various embodiments may have a wide variety of different shapes, sizes and configurations. Additional embodiments of the container 200 may be provided without any rim or may include a rim which only surrounds a portion of fill opening.

The fill opening 300 of the top lid 216 of illustrated embodiment of container 200 includes a screen 304, which covers the fill opening 300. The screen 304 is generally provided to allow for the passage of material that are desired to be inserted into container 200, such as food grease, but to help prevent trash, debris, food matter, or other contaminants from entering container 200. Screen 304 also generally serves to prevent undesired entry into the container 200 via fill opening 300, such as by potential grease thieves (using, for example, a vacuum tube), animals, etc. The screen 304 of the illustrated embodiment is a mesh screen, however additional embodiments of container may include a variety of different screens, partitions, barriers or filters such as slotted plates, perforated screens, etc. The screen 304 of various embodiments may have a wide variety of different shapes, sizes and configurations. Additional embodiments of the fill opening 300 of the top lid 216 of container 200 may be provided without any screen or may include a screen which only covers a portion of fill opening.

As shown in FIGS. 6-8, the exemplary embodiment of container 200 includes an optional fill opening door 222, which selectively covers the fill opening 300 of the top lid 216 (shown in FIGS. 7-8). The fill opening door 222 is mounted to top lid 216 by a pair of hinges 224. Fill opening door 222 may include any number of hinges. Fill opening door 222 may be mounted to the top lid 216 of the container 200 in a variety of different ways in additional embodiments, including by use of various different types of hinges. In yet additional embodiments, fill opening door 222 may be unattached to the top lid 216 of container 200 and simply rest upon and be removable from the top lid 216 of container 200. Furthermore, in additional embodiments, the container 200 may be provided with no fill opening door 222 and the fill opening 300 defined in top lid 216 may open at all times and uncovered by a door.

The fill opening door 222 may include an optional handle 226 to assist a user in lifting fill opening door 222. The fill opening door 222 may include any number of handles or other suitable means to assist the opening and closing of the fill opening door 222 by a user.

As shown in FIGS. 6-8, fill opening door 222 is selectively pivoted on hinges 224 between a closed position, in which the fill opening 300 (shown in FIGS. 7-8) defined within the top lid 216 is covered, and an open position, in which the fill opening 300 is uncovered. Fill opening door 222 may have a variety of different suitable shapes, sizes and configurations. Additional embodiments of container 200 may include various different types of fill opening doors. For example, in certain embodiments, fill opening door 222 may be a pair of doors that each cover half of the fill opening 300, or one or more sliding panels that slides between a closed and open position or a rotating door that rotates between a closed and open position.

The fill opening door 222 may be formed from a variety of materials. In the embodiment of container 200 illustrated in FIG. 6, fill opening door 222 is made from one or a combination of thermoplastic or elastomeric materials, such as plastic. In various additional embodiments, the fill opening door 222 may be made from one or a combination of metals, such as steel or aluminum. In yet additional embodiments, various parts of fill opening door 222 may be made from different materials to provide varied properties at discrete portions of the door. For example, in certain embodiments, a portion of fill opening door 222 may be formed of metal while the remaining portions of the door is formed of thermoplastic or elastomeric materials. In certain embodiments, the top lid 216 and fill opening door 222 mounted on the top lid 216 may be formed from the same material and in additional embodiments, the top lid 216 and fill opening door 222 may be formed from different materials.

In certain embodiments, fill opening door 222 is selectively locked in the closed position by one or more optional securing device (not shown) to prevent undesired entry into the fill opening 300, such as by potential grease thieves (using, for example, a vacuum tube), animals, etc. Any suitable securing device may be used to secure fill opening door 222 in the closed position and/or open position, such as one or more padlocks, locking bars, chains, straps, tie-downs, bungee cords, key locks, panel locks, sash locks, deadbolts, dead latches, bolt latches or other type of lock or latch. Additional embodiments of container may also include an additional securing device to secure fill opening door 222 in the open position or may not include any securing device for securing fill opening door 222.

Additional embodiments of the container 200 may include a support tray (not shown) located on a portion of the container 200 to provide a place for a user of the container 200 to place or rest a waste container, trash can, pail bucket or other items, while using the container 200. For example, a user of container 200 could use optional support tray to support a grease pail while the user is opening fill opening door 222 to access fill opening 300. Once fill opening door 222 is opened and the fill opening 300 is accessible, the user could then remove the grease pail from optional support tray and dump the contents of the grease pail into container 200 via fill opening 300. Yet further additional embodiments of container 200 may include an overall container shape that provides the functions of the support tray.

Figure 9:
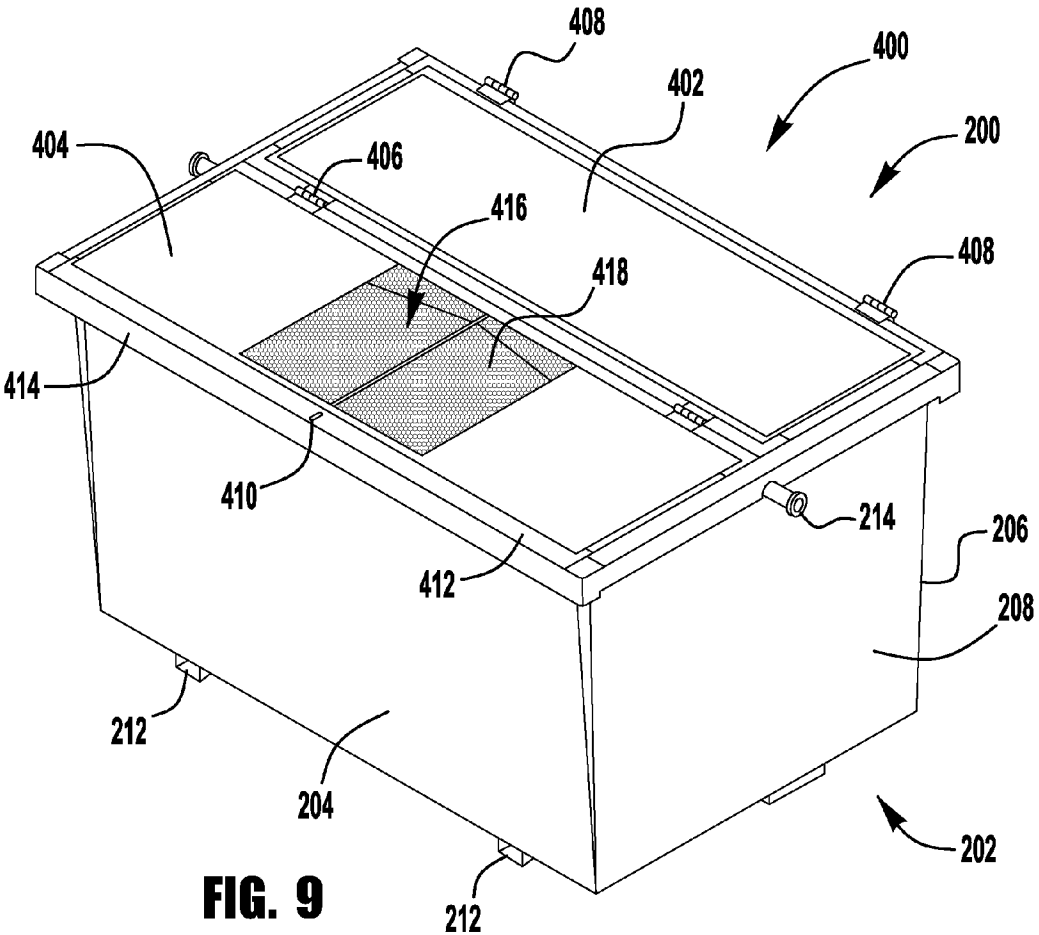
FIG. 9 shows a perspective view of the embodiment of the container in FIG. 6, with the top lid removed and the primary lid being visible for illustrative purposes.
Figure 10:
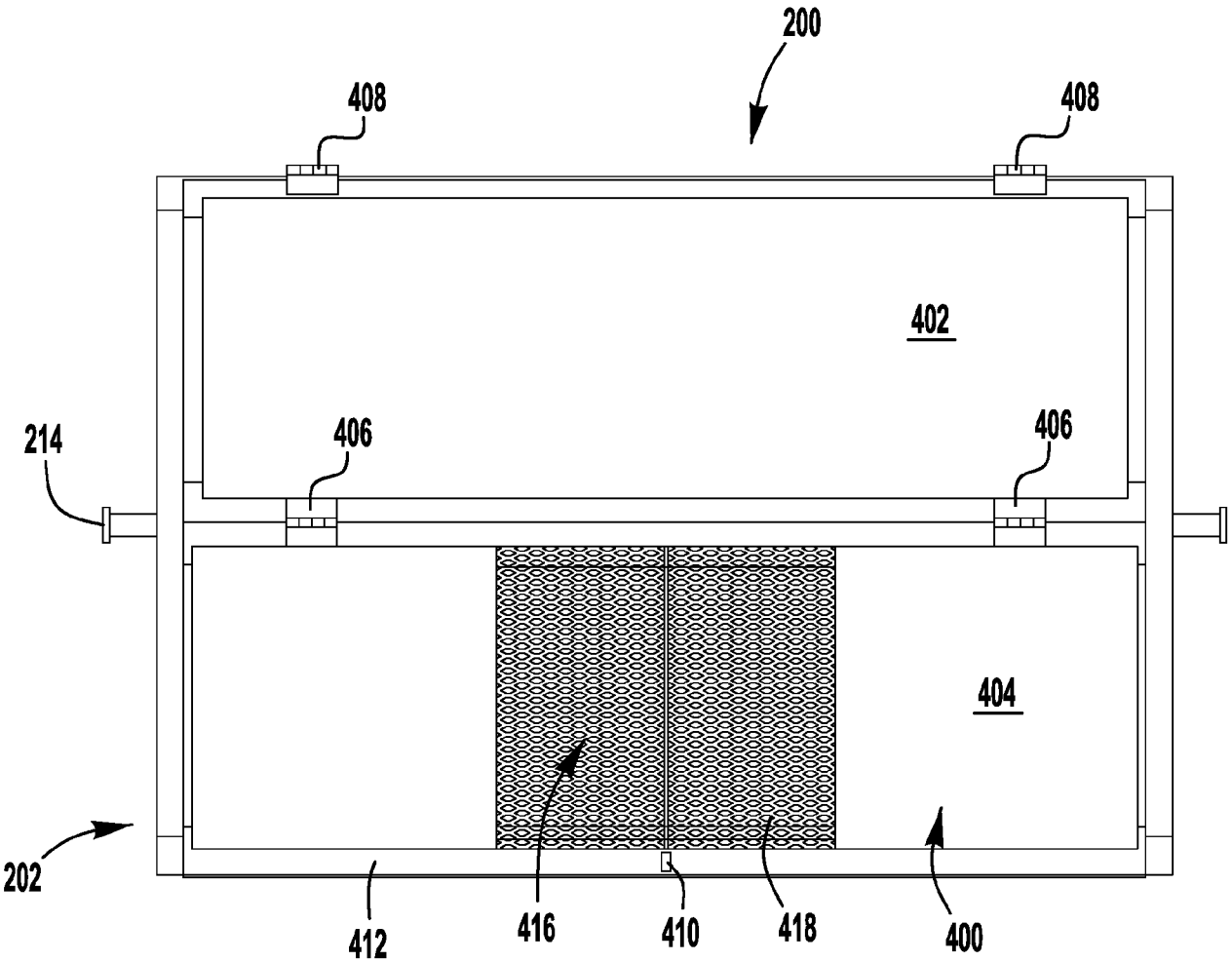
FIG. 10 shows a top view of the embodiment of the container in FIG. 6, with the top lid removed and the primary lid being visible for illustrative purposes.

Referring now to FIGS. 9-10, the illustrated embodiment of container 200 includes a primary lid 400, which selectively encloses the receptacle portion 202 of the container 200. Primary lid 400 may have a variety of different suitable shapes, sizes and configurations. Additional embodiments of container 200 may include various different types of lids. For example, in certain embodiments, primary lid 400 may be a pair of doors that each cover half of the receptacle portion 202 of container 200 or one or more sliding panels that slides between a closed and open position.

Primary lid 400 of the illustrated embodiments of container 200 is a bi-fold lid which includes a rear half panel 402 and front half panel 404 which are joined by a pair of hinges 406. The bi-fold lid of the illustrated embodiment allows the primary lid to be opened in several stages, as described in more detail herein. Front half panel 404 of primary lid 400 may be selectively pivoted on hinges 406 between a closed position, in which the receptacle portion 202 of container 200 is covered, and an open position, in which half of the receptacle portion 202 of container 200 is uncovered. The rear half panel 402 and front half panel 404 of primary lid 400 may be joined by any number of hinges. The rear half panel 402 and front half panel 404 of primary lid 400 may be joined together in a variety of different ways in additional embodiments of the container, including by use of various different types of hinges and joints. In yet additional embodiments of container 200, the primary lid may be a one-piece lid or may be constructed of more than two panels.

The primary lid 400 is mounted to the receptacle portion 202 of container 200 by a pair of hinges 408 located on the rear half 402 of primary lid 400. As described in more detail herein, primary lid 400 is selectively pivoted on hinges 408 between a closed position, in which the receptacle portion 202 of container 200 is covered, and an open position, in which the receptacle portion 202 of container 200 is uncovered. Primary lid 400 may be mounted to the receptacle portion 202 by any number of hinges. Primary lid 400 may be mounted to the receptacle portion 202 of the container 200 in a variety of different ways in additional embodiments of container, including by use of various different types of hinges and joints. In yet additional embodiments, primary lid 400 may be unattached to the receptacle portion 202 of container 200 and simply rest upon and be removable from the receptacle portion 202 of container 200. Furthermore, in additional embodiments, the container 200 may be provided without a primary lid 400. In various embodiments, primary lid 400 may include an optional handle or other suitable means to assist the opening and closing of the primary lid 400 by a user.

The primary lid 400 may be formed from a variety of materials. In the embodiment of container 200 primary lid 400 is made from one or a combination of metals, such as steel or aluminum. In various additional embodiments, the primary lid 400 may be made from one or a combination of thermoplastic or elastomeric materials, such as plastic. In yet additional embodiments, various parts of primary lid 400 may be made from different materials to provide varied properties at discrete portions of the lid. For example, in certain embodiments, a portion of primary lid 400 may be formed of metal while the remaining portions of the lid is formed of thermoplastic or elastomeric materials. The primary lid 400 may be manufactured by one of a variety of methods of making containers that are well known in the art. For example, primary lids made of metal can be constructed by welding or other fabrication methods and primary lids made of thermoplastic or elastomeric materials may be constructed by molding processes, such as an injection or rotational molding process.

The illustrated embodiment of the primary lid 400 includes an opening 410 for receiving an optional securing device (not shown) for securing the primary lid 400 in the closed position to prevent undesired entry into the container 200, such as by potential grease thieves (using, for example, a vacuum tube), animals, etc. The opening of 410 of primary lid 400 of the illustrated embodiment aligns with an opening 700 defined through flange 414 of the receptacle portion 202 of container 200. In this manner, a securing device may be passed through opening 410 of primary lid and opening 700 of container 200 to secure primary lid 400 in a closed position relative to container 200. Any suitable securing device may be used to secure primary lid 400 in the closed position, such as one or more padlocks, locking bars, chains, straps, tie-downs, bungee cords, key locks, panel locks, sash locks, deadbolts, dead latches, bolt latches or other type of lock or latch. Additional embodiments of container may also include an additional securing device to secure primary lid 400 in the open position and/or the half-open position (i.e., front half panel 404 of primary lid 400 folded over on rear half panel 404 in the open position).

In the illustrated embodiment of container 200, top lid 216 includes a projection (not shown) extending downwardly from the bottom surface of top lid 216 which is received through opening 410 of primary lid 400 and opening 700 of the flange 414 of the receptacle portion 202 of container 200 when the top lid 216 is in the closed position. Once the projection of the top lid 216 extends through openings 410, 700, an optional securing device (not shown) is used to lock top lid 216 in the closed position. In this manner, both the top lid 216 and primary lid 400 can be locked in the closed position using a single securing device. In additional embodiments, the top lid 216 and primary lid 400 may be locked in the closed position by a variety of suitable methods. In certain embodiments, the top lid 216 and primary lid 400 are locked in the closed position independently of one another using separate securing devices. In yet additional embodiments, one or more of the top lid 216 and/or primary lid 400 are not locked into the closed position using a securing device. In yet additional embodiments, one or more of the top lid 216 and/or primary lid 400 may also be locked in an open position (or, in the case of a bi-fold primary lid, in a half-open or fully open position) by a securing device.

The illustrated embodiment of primary lid 400 includes an optional lip 412. The lip 412 extends from both the rear half panel 402 and front half panel 404 over a flange 414 of the receptacle portion 202 of container 200. The overlap of the lip 412 of primary lid 400 over the flange 414 provides additional security against undesired entry into the container 200 (such as, for example, entry into the container by a vacuum tube). For example, if the primary lid 400 is locked in the closed position, the overlap of the lip 412 over the flange 414 serves to provide an added security measure to prevent the primary lid from being opened, such as by a potential grease thief attempting to insert a tool or other element under the primary lid 400 to pry it upward or otherwise separate it from the container 200. The lip 412 of primary lid 400 may have a variety of sizes, shapes and configurations. In the illustrated embodiment, the lip 412 extends rearward from the rear of the rear half panel 402 of the primary lid and extends forward from the front of the front half panel 404. In additional embodiments, the lip 412 may extend outward from all edges of the primary lid 400 to cover over the flange 414 of the receptacle portion 202 of container 200. In yet further additional embodiments, the primary lid 400 may be provided without such a lip 412.

In the illustrated embodiment of container 200, the top lid 216 is positioned above the primary lid 400 and the top lid 216 and primary lid 400 both serve to enclose the receptacle portion 202 of the container 200. The use of the top lid 216 and the primary lid 400 in combination with one another serves to both protect against the undesired entry of contaminants into the container and also provide security against the theft of the food grease or other contents of the container 200 (such as, for example, by a thief using a vacuum tube).

The top lid 216 serves to protect against the elements (e.g., rain, sleet, snow, etc.), other contaminants (e.g., leaves, dirt, litter, etc.), insects or rodents from entering the container 200. As the top lid 216 of the illustrated embodiment extends beyond and hangs over the perimeter of the container 200, it serves as a barrier which prevents such things from entering the container. Since the top lid 216 of the illustrated embodiment serves this barrier function, the primary lid 400 of the illustrated embodiment need not be constructed in a manner that necessarily prevents the entry into the container 200 of such contaminants. For example, the hinges 406, 408 of primary lid 400 or the joint between rear half panel 402 and front half panel 404 of primary lid need not be water tight, as the top lid 216, which overlies the primary lid 400, serves to prevent undesired things, such as rainwater, from entering the container 200. Similarly, for this same reason, the interface between the primary lid 400 and the container 200 need not provide a tight seal or be water tight. It should be understood, however, that in additional embodiments of container 200, the hinges 406, 408, the joint between rear half panel 402 and front half panel 404 of primary lid 400, and/or the interface between the primary lid 400 and the container 200 may be water-tight. Also, it should be understood that additional embodiments of container 200 are provided without top lid 216 and only include primary lid 400.

Since the interface between the primary lid 400 of the illustrated embodiment and container 200 need not provide a tight seal, the primary lid can be recessed with respect to the perimeter of the container 200 (i.e., the sides of the primary lid 400 of the illustrated embodiment do not extend to the edges of the container 200 as best illustrated in FIG. 5). Because the sides of the primary lid 400 do not extend to the edges of the walls of container 200, it is harder for a thief or vandal to insert a tool or other object under the primary lid 400 in an effort to pry or lift up primary lid 400. Also, the top lid 216 (and fill opening lid 222) of the illustrated embodiment serve as an additional barrier or impediment against a would-be thief or vandal, because even if a potential grease thief were able to pry up or remove the top lid 216 (or fill opening lid 222), the primary lid 400 would remain to prevent unauthorized entry into the container 200.

Figure 4:
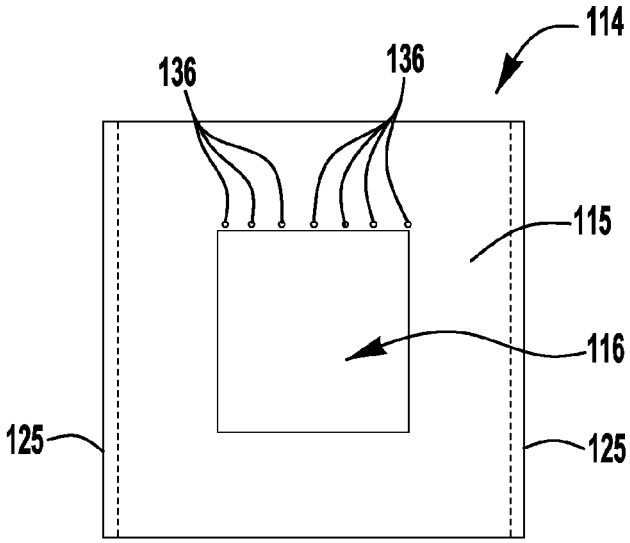
FIG. 4 shows a top view of the top wall of the lid of FIGS. 3A-3B.

Referring again to FIGS. 4-5, the illustrated embodiment of primary lid 400 includes a fill opening 416 defined through the primary lid 400. The fill opening 416 is generally provided to facilitate the loading of container 200 with food grease or other materials by a user, as described in greater detail herein. The fill opening 416 may have a wide variety of different shapes and sizes. In the illustrated embodiment of container 200, the fill opening 416 has a generally rectangular shape. However, the fill opening of additional embodiments of primary lid 400 may have a variety of different shapes. For example, the fill opening 416 of additional embodiments of container 200 may have a circular, elliptical or other suitable shape. Also, additional embodiments of primary lid 400 may have more than one fill opening 416. For example, certain additional embodiments of primary lid 400 may include two or more fill openings 300, each defined through the primary lid 400.

In the illustrated embodiment of container 200, the fill opening 300 defined in the top lid 216 is aligned with the fill opening 416 of the primary lid 400. The alignment of the fill opening 300 with fill opening 416 allows for food grease or other materials that are inserted into the fill opening 300 of top lid 216 by a user to pass through the fill opening 416 of primary lid 400 into the receptacle portion 202 of container 200. Accordingly, a user may insert food grease or other material into the container 200 with both the top lid 216 and primary lid 400 in the closed position (and locked if the container is provided with securing devices to secure the top lid 216 and/or primary lid 140). Since the top lid 216 and primary lid 400 need not be opened (or unlocked) to insert food grease or other materials into the container 200, the container 200 remains secure during operation from unwanted entry into the container 200 even when food grease or other materials are being inserted into the container 200. Therefore, users of the container 200 need not utilize keys or other unlocking devices to unlock or open the top lid 216 or primary lid 400 when they desire to pour or otherwise insert materials into the container 200. A user simply lifts the fill opening door 222 (if the particular embodiment of container 200 is provided with such a fill opening door) and inserts material into the container 200 via fill opening 300 and fill opening 416. As previously indicated, certain additional embodiments of the container 200 do not include a top lid 216 or primary lid 400 and such embodiments will only include one fill opening.

The fill opening 416 of primary lid 400 of the illustrated embodiment of container 200 includes a screen 418, which covers the fill opening 416. The screen 418 is generally provided to allow for the passage of material that are desired to be inserted into container 200, such as food grease, but to help prevent trash, debris, food matter, or other contaminants from entering container 200. Screen 418 also generally serves to prevent undesired entry into the container 200 via fill opening 416, such as by potential grease thieves (using, for example, a vacuum tube), animals, etc. The screen 418 of the illustrated embodiment is a mesh screen, however additional embodiments of container may include a variety of different screens, partitions, barriers or filters such as slotted plates, perforated screens, etc. The screen 418 of various embodiments may have a wide variety of different shapes, sizes and configurations. Additional embodiments of the fill opening 416 of primary lid 400 of container 200 may be provided without any screen or may include a screen which only covers a portion of fill opening. In certain additional embodiments, only one of the fill opening 416 of primary lid 400 or fill opening 300 of top lid 216 include a screen. For example, in certain additional embodiments, fill opening 300 may include screen 304, but fill opening 416 may not include a screen.

Figure 11:
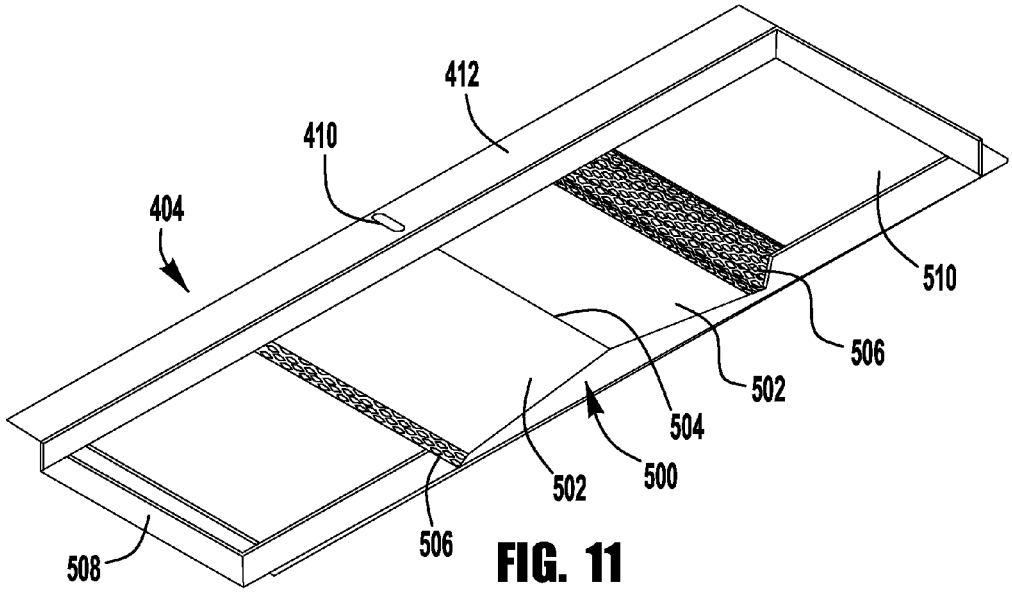
FIG. 11 shows a bottom perspective view of the front half of the primary lid of the embodiment of the container in FIG. 6.
Figure 12:
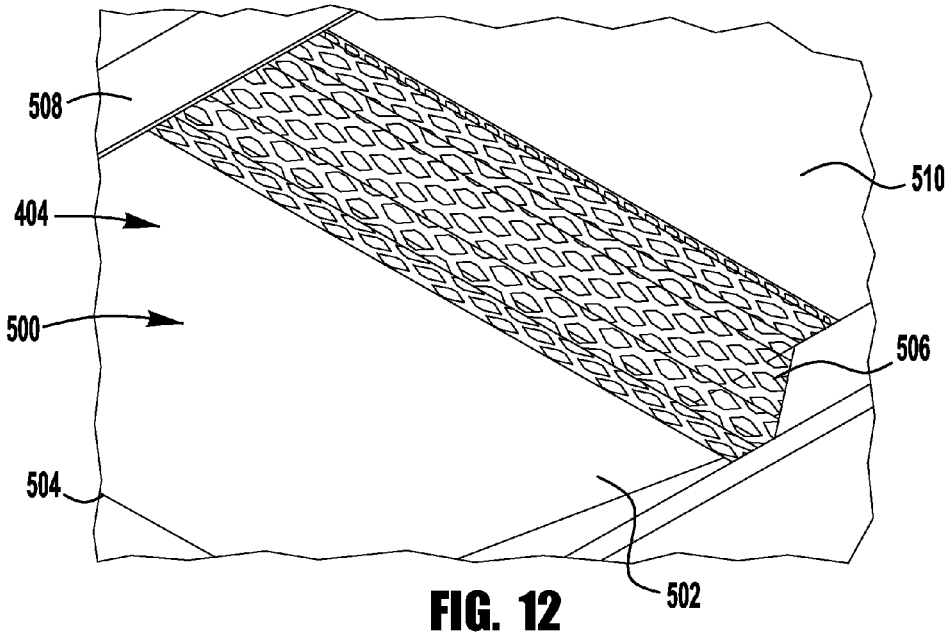
FIG. 12 shows a close-up partial bottom perspective view of the diverter plate and angle grate of the front half of the primary lid of the embodiment of the container in FIG. 6.

Referring now to FIGS. 11-12, a diverter 500 is mounted on the underside of primary lid 400 beneath the fill opening 416. The diverter 500 of the illustrated embodiment includes a pair of angled diverter plates 502 which meet at peak 504. The diverter 500 serves to divert the flow of material inserted into fill opening 416 in the primary lid 400. As material is inserted into fill opening 416 of the primary lid 400 of the illustrated embodiment of container 200, it will pass through screen 418 and then contact diverter 500. The material will then flow down one or both of angled diverter plates 502 and enter container 200. The diverter 500 of the illustrated embodiment includes a pair of screened sections 506 located at the lower end of each diverter plate 502 and spanning the width of the diverter plates 502. The screened sections 506 serve to provide an additional barrier against undesired items, such as debris, entering the container 200 and to prevent undesired entry into the container 200, such as by potential grease thieves (using, for example, a vacuum tube), animals, etc. Various additional embodiments of diverter 500 may be provided without screened sections 506.

The diverter 500 serves to obstruct the view of the interior of the container 200 through the fill opening 416. This obstruction of the view of the interior of the container 200 can serve as another deterrent against the theft of the contents of the container 200. For example, if a potential grease thief cannot visually determine if the container 200 holds any food grease, this may discourage the potential grease thief from attempting to break into the container 200. The diverter 500 also serves to prevent a vacuum tube or other similar device from being inserted into the container 200 via fill opening 416 in an effort to remove the contents of the container 200. The diverter 500 may be fashioned from a variety of suitable materials, such as one or a combination of metals, such as steel or aluminum, or one or a combination of thermoplastic or elastomeric materials, such as plastic. The diverter 500 may have a variety of different shapes, sizes and configurations in various embodiments of container 200. Additional embodiments of container 200 may be provided without a diverter 500.

Referring again to FIG. 11, each of the rear half panel 402 and front half panel 404 of primary lid 400 include a flange 508 which extends downwardly from the underside 510 of the panels 402, 404 of primary lid around the perimeter of the panels 402, 404. Flange 508 is configured to extend downwardly into container 200 when the rear half panel 402 and/or front half panel 404 of primary lid 400 are in the closed position. The extension of the flange 508 downwardly into the container provides an additional measure that serves to prevent a potential grease thief from inserting a tool or other object under the primary lid 400 in an effort to pry up or remove the primary lid 400. The flange 508 also provides an additional level of security against a vacuum tube or similar device being inserted into the container in an effort to remove the contents of the container 200. In addition, an option drain could be provided for draining the contents of the container. Additional embodiments of primary lid 400 of container 200 may be provided without such a flange.

Containers of the instant invention are intended for use with the collection, storage and transport of a variety of materials, including waste and refuse material, such as food grease. In use, container 200 is placed in a desired location on a sufficient support surface. A user of the container 200 opens fill opening door 222 to access fill opening 300 of top lid 216. The user of container 200 then pours the desired food grease or other material through screen 304 of fill opening 300. The food grease or other material then passes through screen 418 of fill opening 416 of primary lid 400, contacts diverter 500, and flows or passes through screened sections 506 into the receptacle portion 202 of container 200. As discussed, additional embodiments of container 200 may include a support tray or other device for use to support a container, such as a grease pail, during the loading of food grease or other materials into container 200.

Figure 13A:
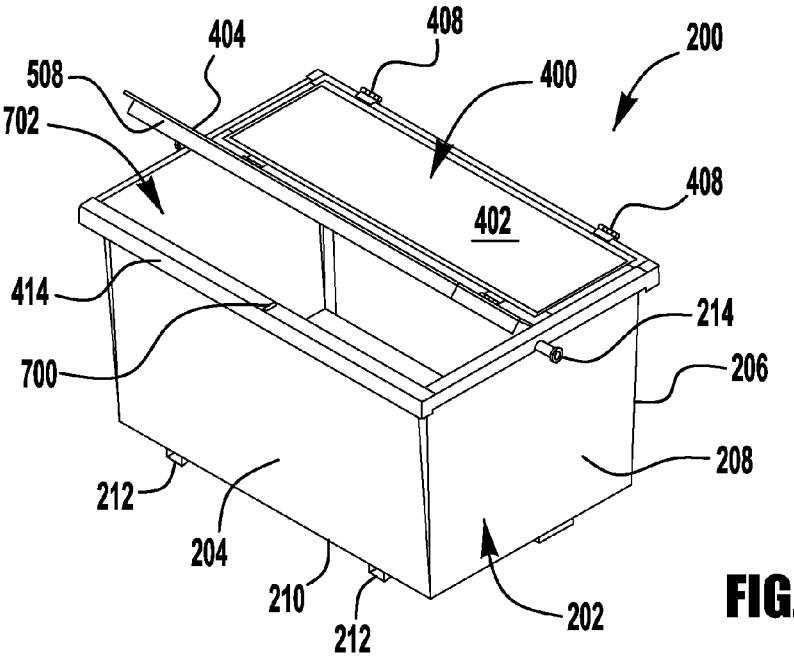
FIG. 13A-13D show perspective views of the embodiment of the container in FIG. 6, with the primary lid in various stages of opening (with the top lid removed for illustrative purposes)
Figure 13B:
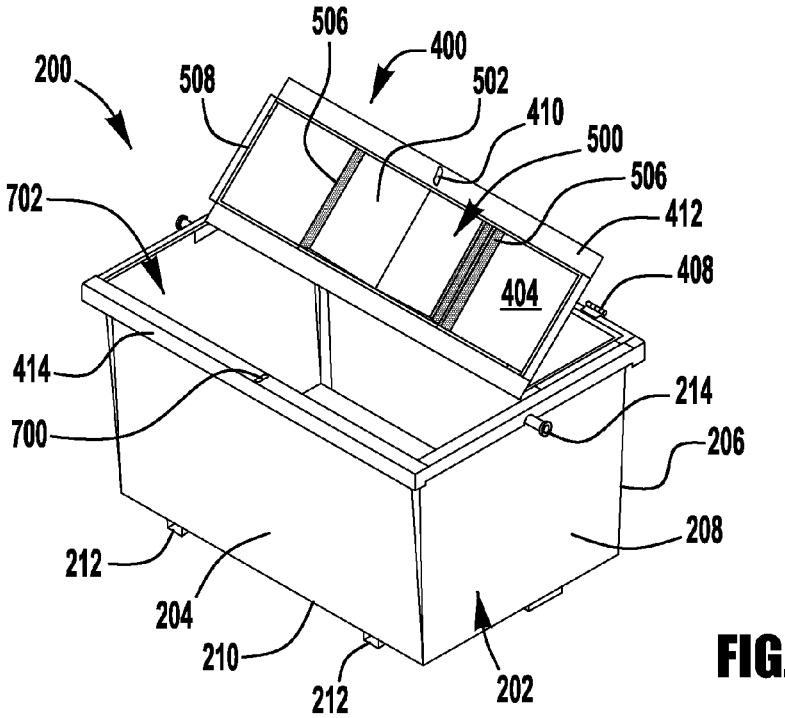
Figure 13C:
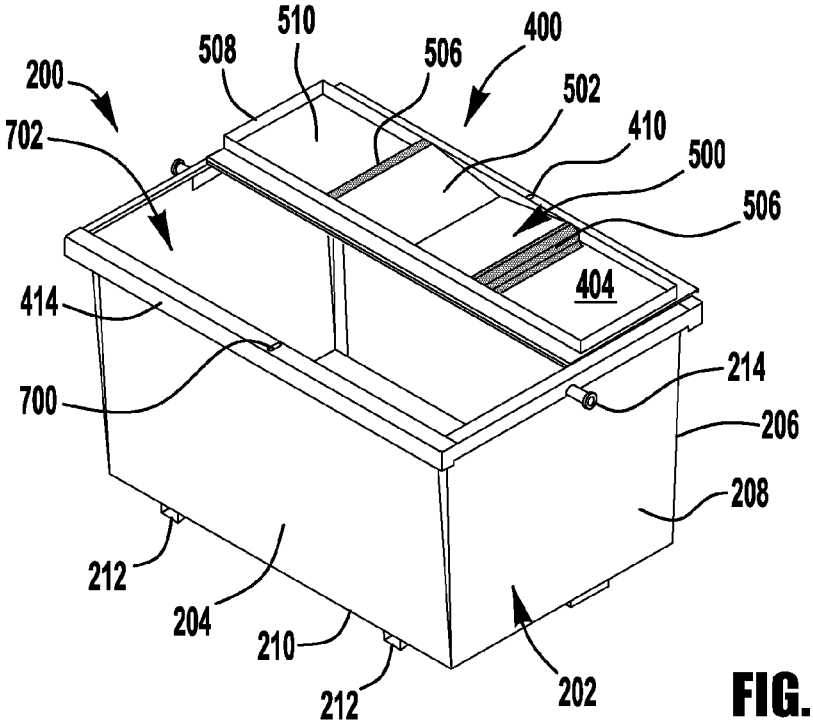
Figure 13D:
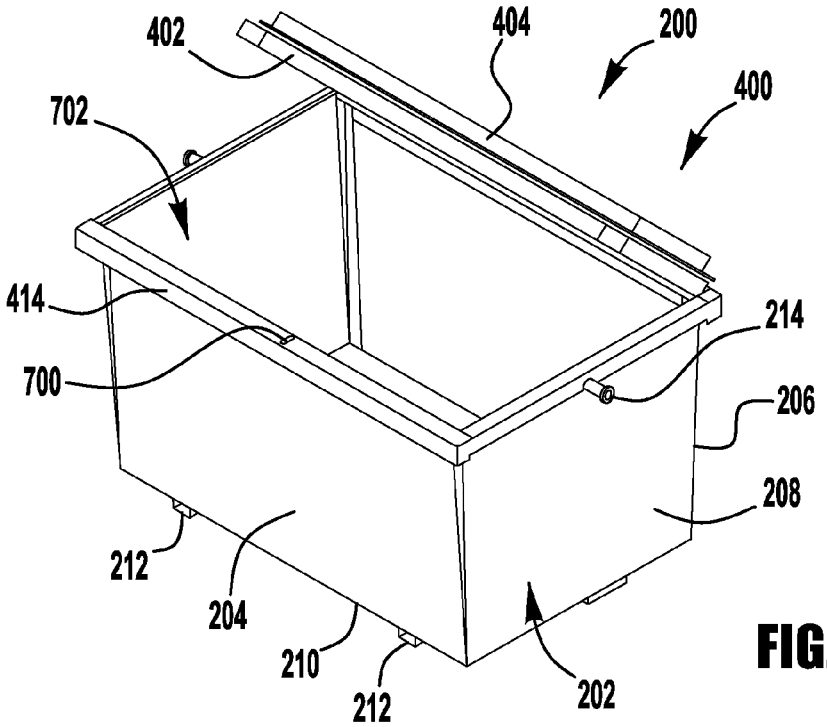

When container 200 becomes full or it is otherwise desired that container 200 be emptied, a waste removal vehicle is used to empty the container 200. When it is desired that the container 200 be emptied, top lid 216 is opened (or removed if the embodiment of container 200 includes a top lid 216 that is not hingeably mounted to the container). As shown in FIGS. 13A-13D, the primary lid 400 can be opened in stages. The front half panel 404 can first be opened using hinges 406 and folded back onto the rear half panel 402 of primary lid, as best illustrated in FIGS. 13A-13C. With the primary lid 400 in this half-open position with the front half panel 404 overlying the rear half panel 402, the contents of interior 700 of container 200 can be emptied by tipping container 200 forward to dump the contents of the container 200. An optional securing device may be provided in various embodiments of container 200 to lock the primary lid 400 in this half-open position, so that one or both of the front half panel 404 or rear half panel 402 are prohibited from moving relative to the container 200 when the container is tipped to empty the contents of the container. The contents of the container may also be emptied by placing a vacuum tube or similar device into the container via the opening created by the folding back front half panel 404 onto the rear half panel 402 to suck out the contents of the container 200. As shown in FIG. 13D, the complete primary lid 400 may also be opened (either with the front half panel 404 folded back to overly the rear half panel 402 or otherwise) if it is desired that the opening of container be entirely unobstructed in order to empty the container 200, clean out the interior of the container 200 or for some other desired purpose.

Additional Exemplary Embodiment of Container Lid/Grease Grate Tray

Figure 14:
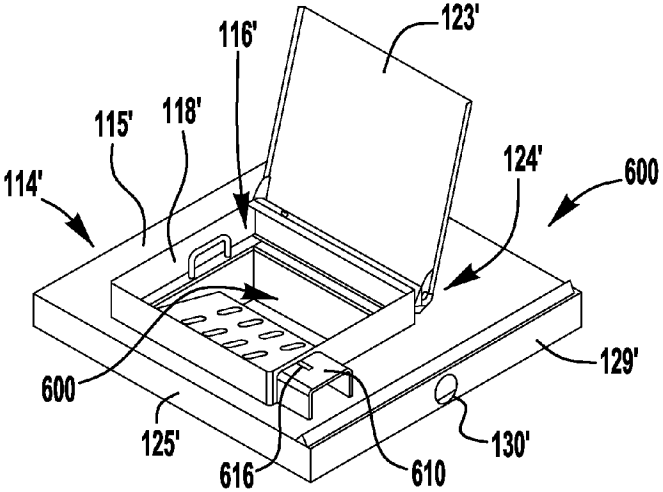
FIG. 14 shows a perspective view of an additional exemplary embodiment of a container lid.

Referring now to FIG. 14, an additional exemplary embodiment of a top lid 600 for a container is shown. The prime symbol is utilized in FIG. 14 to indicate elements of lid 600 which may be similar but may not be identical to elements of top lid 114. The exemplary embodiment of top lid 600 serves to enclose the receptacle portion of a container to prevent undesired entry into the container, such as by potential grease thieves (using, for example, a vacuum tube), animals, etc.

Top lid 600 may have a variety of different suitable shapes, sizes and configurations. The top lid 600 of the illustrated embodiment may be formed from a variety of materials and may be manufactured by one of a variety of methods that are well known in the art. The illustrated embodiment of top lid 600 includes a top plate 115' with a fill opening 116' defined therethrough. As shown in FIG. 14, the fill opening 116' of the illustrated embodiment of top lid 600 includes a rim 118', which generally surrounds or borders (at least a portion of) the fill opening 116'. The fill opening 116' of the illustrated embodiment of the top lid 600 includes a grease grate tray 602, which generally spans and covers the fill opening 116'. The grease grate tray 602 is generally provided to allow for the passage of material that are desired to be inserted into the fill opening 116, such as food grease, but to help prevent trash, debris, food matter, or other contaminants from entering container 100. Grease grate tray 602 also generally serves to prevent undesired entry into a container via fill opening 116' of top lid 600, such as by potential grease thieves (using, for example, a vacuum tube), animals, etc.

Referring now to FIGS. 15A-15D, the grease grate tray 602 of the illustrated embodiment generally includes a main body 620 that is generally made up of a rear wall 620, a pair of side walls 624, angled front wall 626, mesh screen portion 628, front lip portion 632, and interior bottom wall 660, which combine to create a partially enclosed space. The shape and configuration of each of the walls 620, 624, 626, 660, mesh screen portion 628, and front lip portion 632 may vary in various embodiments. In addition, the overall shape of the grease grate tray 602 may also vary in various embodiments. The grease grate tray 602 is not limited to the shape of the illustrated exemplary embodiment of the grease grate tray 602 and additional embodiments of the grease grate tray 602 could have a variety of suitable shapes. The walls 620, 624, 626, 660, mesh screen portion 628, and front lip portion 632 of the illustrated embodiment of the grease grate tray 602 may be formed of one or more of a variety of suitable materials. The particular material is generally selected to be compatible with the intended purpose and desired qualities of the container 100. For example, in various embodiments, the grease grate tray 602 may be made from one or a combination of metals, such as steel or aluminum. The grease grate tray 602 may be manufactured by one of a variety of methods, such as, for example, the grease grate tray may be constructed by welding the walls together.

Figure 15B:
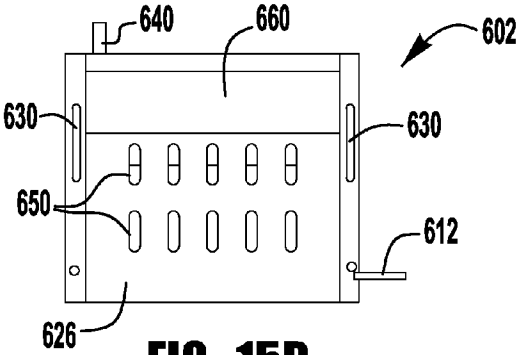
FIG. 15B shows a top view of the grease insert tray of the embodiment of the lid in FIG. 14.
Figure 15C:
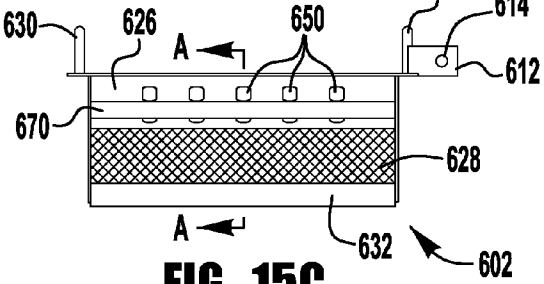
FIG. 15C shows a front view of the grease insert tray of the embodiment of the lid in FIG. 14.

As shown in FIGS. 14, 15B, and 15C, the angled front wall 626 of the illustrated exemplary embodiment of the grease grate tray 602 includes a plurality of openings 650 that are defined through the angled front wall 626. The openings of the illustrated embodiment have a generally elliptical shape. However, the openings may have a variety of suitable shapes in various additional embodiments, such as, for example, a rectangular, circular, or other shape. The illustrated embodiment of grease grate tray 602 includes 10 openings 650 arranged in two parallel rows. However, any number of openings in any number of rows or other configuration may be provided in additional embodiments. The illustrated exemplary embodiment of the grease grate tray includes an optional crossbeam or support bar 670 to provide further support for the angled front wall 626. Additional embodiments may be provided without such a support bar.

Figure 15D:
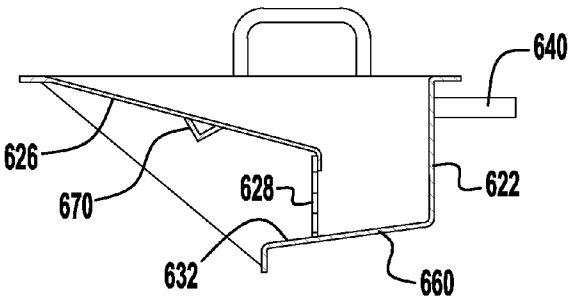
FIG. 15D shows a cross-sectional view of the grease insert tray of the embodiment of the lid in FIG. 14 taken along line A-A.

When grease or other materials that are desired to be inserted into the container are poured or otherwise placed within the grease grate tray 602 they travel downward over the angled front wall 626. All or a portion of the material will enter the openings 650 of the angled front wall and fall downwardly into the interior of the container on which the top lid is mounted 600. However, the openings 650 are configured, to prevent undesired items, such as trash, debris, food matter, or other contaminants from entering container that are too large to fit through openings 650. These undesired items will travel downwardly along the angled front wall (with additional grease or other material that has not entered the container through openings 650) and collect on the bottom wall 660 in the interior of the grease grate tray. Due to the slope of bottom wall 660 (as best illustrated in FIG. 15D), any remaining grease or other material that remains will travel toward mesh screen portion 628 of the grease grate tray 602. All or a portion of such additional grease or other material will pass through the mesh screen portion 628 and travel along the front lip portion 632 and drop downwardly into the container. However, the mesh screen portion 628 is configured, to prevent undesired items, such as trash, debris, food matter, or other contaminants from entering the container that are too large to fit through the openings of the mesh screen portion 628. These undesired items will collect on the bottom wall 660 in the interior of the grease grate tray and remain there. Such undesired items can then be removed from the grease grate tray 602 and discarded.

In the illustrated embodiment of grease grate tray, the mesh screen portion 628 is a metal, mesh screen, however additional embodiments of grease grate tray 602 may include a variety of different grates, screens, partitions, barriers or filters such as slotted plates, perforated screens, etc. which are formed from a variety of suitable materials.

The grease grate tray 602 of the illustrated embodiment and, specifically, the angled front wall 626 and mesh screen portion 628 are adapted to generally allow for the passage of materials that are desired to be inserted into the fill opening 116', such as food grease, but helps to prevent trash, debris, food matter, or other contaminants from entering the container. The angled front wall 626 and mesh screen portion 628 of the grease grate tray 602 also serve to help prevent undesired entry into a container via fill opening 116' of top lid 600, such as by potential grease thieves (using, for example, a vacuum tube), animals, etc. For example, the relatively thick material used to form angled front wall 626 is adapted to be difficult to penetrate or cut through with tools other than, perhaps, a plasma cutter or substantially powerful cutting tool. As such, the angled front wall helps to deter attempts to break into the container by would be thieves. Likewise, the location, configuration and material makeup of the mesh screen portion 628 and other portions of the grease grate tray help to deter or prevent undesired attempts of entry into the container.

Figure 15A:
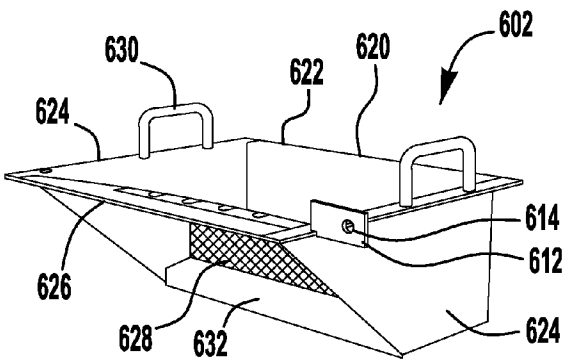
FIG. 15A shows a perspective view of the grease insert tray of the embodiment of the lid in FIG. 14.

As shown in FIG. 14, the illustrated embodiment of top lid 600 includes a shroud 610 located adjacent the rim 118' that borders the fill opening 116'. The shroud may have a variety of suitable shapes, constructions and configuration in various embodiments of the top lid. In the illustrated embodiment, the shroud has a generally rectangular shape when viewed from the side. As shown in FIGS. 15A-15C, the illustrated exemplary embodiment of grease grate tray 602 includes a locking plate 612 that extends outwardly from a side wall 624 of grease grate tray 602. Opening 614 defined through locking plate 612 is adapted to receive a securing device (not shown). A variety of different types of securing device may be used in various embodiments of the grease grate tray 602. For example, opening 614 of locking plate 612 may receive, for example, the shackle of a padlock. The locking plate 612 of the illustrated embodiment of grease grate tray has a generally rectangular shape. However, in additional embodiments, the locking plate may have a variety of different shapes and configurations.

In the illustrated embodiment of exemplary top lid 600, shroud 610 includes a slot 616 that is defined in the upper surface of the shroud. The slot 616 is adapted to permit the locking plate 612 to slide or otherwise enter therethrough and travel downwardly through the upper surface of the shroud into the interior space defined by the shroud 610. Once the locking plate is located within the interior space defined by the shroud, a padlock or other securing device can be attached to the locking plate 612 (via the opening 614 defined through the locking plate) to secure the locking plate 612 within the shroud 610 and to prevent withdrawal of the locking plate 612 from the shroud 610 until the securing device is removed from the locking plate 612 (and, thus, also prevent the grease grate tray 602 from being lifted upwardly until the securing device is removed from the locking plate 612).

As shown in FIGS. 15A-15C, the illustrated grease grate tray 602 includes a pair of handles 630 for assisting a user to insert and remove the grease grate tray 602 from the fill opening 116'. The handles may have a variety of shapes and configuration in various embodiments of the grease grate tray 602 and a variety of different numbers of handles (e.g., one, two, three, four, etc.) may be provided. Various additional embodiments of the grease grate tray 602 may also be provided without any such handles.

As shown in FIGS. 15B and 15D, the illustrated embodiment of the grease grate tray 602 includes a locking pin 640 that extends outwardly from the rear wall 622 of the grease grate tray 602. The locking pin 640 may have a variety of shapes and configuration in various embodiments of the grease grate tray 602 and a variety of different numbers of locking pin 640 may be provided in various embodiments. Various additional embodiments of the grease grate tray 602 may also be provided without any such locking pin 640.

To insert the grease grate tray 602 into top lid 600, a user may grasp handles 630 and lower grease grate tray 602 into the fill opening 116'. Locking pin 640 is adapted for secure receipt into an aperture or opening (not shown) defined within a portion of the top lid 600. Once locking pin 640 is located within corresponding opening defined within a portion of the top lid 600, the rear of the grease grate tray 602 is generally secured and prevented from movement relative to the top lid 600. The front of the grease grate tray 602 may then be pivoted downwardly and the locking plate 612 inserted through slot 616 of shroud 610. Once the locking plate 612 is located within the interior space defined by the shroud 610, a padlock or other securing device can be attached to the locking plate 612 (via the opening 614 defined through the locking plate 612) to secure the locking plate 612 within the shroud 610 and to prevent withdrawal of the locking plate 612 from the shroud 610 until the securing device is removed from the locking plate 612 (and, thus, also prevent the grease grate tray 602 from being lifted upwardly until the securing device is removed from the locking plate 612).

In this manner, the grease grate tray 602 is secured within the fill opening 116' of top lid 600 and cannot be removed unless and until the securing device is removed from the locking plate 612. The shape and dimensions of the shroud 610 of the illustrated embodiment of top lid 600 are adapted to generally enclose and house the securing device and protect the securing device to prevent a would-be thief from tampering with the securing device or attempting to remove the securing device by cutting it with bolt cutters or other tool or cutting device. When the grease grate tray 602 of the illustrated embodiment is secured within the fill opening 116' it generally allows for the passage of materials that are desired to be inserted into the fill opening 116', such as food grease, but helps to prevent trash, debris, food matter, or other contaminants from entering the container. Grease grate tray 602 also generally serves to prevent undesired entry into a container via fill opening 116' of top lid 600, such as by potential grease thieves (using, for example, a vacuum tube), animals, etc. It should be understood that grease grate tray 602 may be mounted and secured within the fill opening 116' of the top lid 600 in a variety of suitable manners in additional embodiments.

When the container to which the top lid 600 is mounted becomes full or it is otherwise desired that the container be emptied, the grease grate tray 602 may be removed from the fill opening 116' by removing the securing device from the locking plate 612. The handles 630 may be grasped by a user and the front end of the grease grate tray 602 may be pivoted upward, the locking pin 640 removed from the corresponding aperture defined in the top lid 600 and the grease grate tray may be removed from the unobstructed fill opening 116'. A vacuum device may then be used to empty the contents of the container. A vacuum tube or other vacuum device is then inserted into the open fill opening 116' and the contents of the container are removed. Once the emptying procedure is completed, the grease grate tray 602 is reinstalled, thus preparing the container to be refilled while still preventing access to the contents of the container by potential grease thieves, animals, etc.

It should be understood that exemplary top lid 600 and grease grate tray 602 may be used with any of the previously described embodiments and various features of the various components described herein can be selected and combined to form additional embodiments, all of which are within the scope of this disclosure.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasable or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. A container, comprising:

a receptacle;

a top lid, wherein a fill opening is defined within the top lid;

a rim extending upwardly from the top lid that borders at least a portion of the fill opening;

a fill opening door mounted to the top lid for selectively closing the fill opening;

a screen mounted within the fill opening, wherein the screen is removably secured within the fill opening by a locking device;

wherein the top lid comprises a main portion and a locking end cap, wherein the main portion of the top lid comprises a sidewall and at least two rails configured to engage the rim of the receptacle for mounting the top lid onto the receptacle;

wherein the locking end cap is adapted for selective attachment to the main portion of the top lid opposite the sidewall of the top lid to secure the top lid to the receptacle once the top lid has been mounted onto the receptacle; and wherein the locking device comprises a locking bar and the rim extending upwardly from the top lid comprises at least one opening for receiving the locking bar.

2. The container of claim 1, wherein the locking bar is retained within the rim by at least one securing device.

3. The container of claim 2, wherein the container further comprises a shroud adjacent the rim that is adapted to at least partially enclose the at least one securing device.

4. A container, comprising:

a receptacle;

a top lid, wherein a fill opening is defined within the top lid;

a fill opening door mounted to the top lid for selectively closing the fill opening;

a screen mounted within the fill opening that is removably secured within the fill opening by a locking bar;

a rim extending upwardly from the top lid that borders at least a portion of the fill opening, wherein the rim comprises at least one opening for receiving the locking bar;

wherein the top lid comprises a main portion and a locking end cap, wherein the main portion of the top lid comprises a sidewall and at least two rails configured to engage the rim for mounting the top lid onto the receptacle; and wherein the locking end cap is adapted for selective attachment to the main portion of the top lid opposite the sidewall of the top lid to secure the top lid to the receptacle once the top lid has been mounted onto the receptacle.

5. The container of claim 4, wherein the locking bar is retained within the rim by at least one securing device.

6. The container of claim 5, wherein the container further comprises a shroud adjacent the rim that is adapted to at least partially enclose the at least one securing device.

* * * * *